US011227758B2

(12) United States Patent
Jarrold

(10) Patent No.: US 11,227,758 B2
(45) Date of Patent: Jan. 18, 2022

(54) APPARATUS AND METHOD FOR CAPTURING IONS IN AN ELECTROSTATIC LINEAR ION TRAP

(71) Applicant: THE TRUSTEES OF INDIANA UNIVERSITY, Bloomington, IN (US)

(72) Inventor: Martin F. Jarrold, Bloomington, IN (US)

(73) Assignee: The Trustees Of Indiana University, Bloomington, IN (US)

( * ) Notice: Subject to any disclaimer, the term of this patent is extended or adjusted under 35 U.S.C. 154(b) by 0 days.

(21) Appl. No.: 17/058,556

(22) PCT Filed: Jan. 11, 2019

(86) PCT No.: PCT/US2019/013280
§ 371 (c)(1),
(2) Date: Nov. 24, 2020

(87) PCT Pub. No.: WO2019/236141
PCT Pub. Date: Dec. 12, 2019

(65) Prior Publication Data

US 2021/0210335 A1 Jul. 8, 2021

Related U.S. Application Data

(60) Provisional application No. 62/680,296, filed on Jun. 4, 2018.

(51) Int. Cl.
*H01J 49/42* (2006.01)
*H01J 49/00* (2006.01)
(Continued)

(52) U.S. Cl.
CPC ..... *H01J 49/4245* (2013.01); *H01J 49/0031* (2013.01); *H01J 49/022* (2013.01);
(Continued)

(58) Field of Classification Search
CPC .. H01J 49/4245; H01J 49/0031; H01J 49/022; H01J 49/025; H01J 49/4265; H01J 49/406; H01J 49/426
(Continued)

(56) References Cited

U.S. PATENT DOCUMENTS 3,019,168 A 1/1962 Taylor
5,285,063 A 2/1994 Schwartz et al.
(Continued)

FOREIGN PATENT DOCUMENTS

WO 1998011244 A1 3/1998
WO 1999061601 A1 12/1999
(Continued)

OTHER PUBLICATIONS

PCT International Search Report and Written Opinion completed by the ISA/EP dated Apr. 18, 2019 and issued in connection with PCT/US2019/013251.
(Continued)

*Primary Examiner* — Kiet T Nguyen
(74) *Attorney, Agent, or Firm* — Barnes & Thornburg LLP

(57) ABSTRACT

A system for trapping ions for measurement thereof may include an electrostatic linear ion trap (ELIT), a source of ions to supply ions to the ELIT, a processor operatively coupled to ELIT, and a memory having instructions stored therein executable by the processor to produce at least one control signal to open the ELIT to allow ions supplied by the source of ions to enter the ELIT, determine an ion inlet frequency corresponding to a frequency of ions flowing from the source of ions into the open ELIT, generate or receive a target ion charge value, determine an optimum threshold value as a function of the target ion charge value and the determined ion inlet frequency, and produce at least
(Continued)

one control signal to close the ELIT when a charge of an ion within the ELIT exceeds the optimum threshold value to thereby trap the ion in the ELIT.

20 Claims, 8 Drawing Sheets

(51) Int. Cl.
*H01J 49/02* (2006.01)
*H01J 49/40* (2006.01)

(52) U.S. Cl.
CPC ..... *H01J 49/025* (2013.01); *H01J 49/406* (2013.01); *H01J 49/426* (2013.01)

(58) Field of Classification Search
USPC ..... 250/287, 290
See application file for complete search history.

(56) References Cited

U.S. PATENT DOCUMENTS

| | | | | |
|---|---|---|---|---|
| 5,478,745 | A | 12/1995 | Samulski | |
| 5,572,025 | A | 11/1996 | Cotter | |
| 5,770,857 | A | 6/1998 | Fuerstenau et al. | |
| 5,863,541 | A | 1/1999 | Samulski et al. | |
| 5,869,248 | A | 2/1999 | Yuan et al. | |
| 5,877,022 | A | 3/1999 | Stinchcomb et al. | |
| 5,880,466 | A | 3/1999 | Benner | |
| 5,882,652 | A | 3/1999 | Valdes et al. | |
| 5,886,346 | A | 3/1999 | Makarov | |
| 5,905,040 | A | 5/1999 | Mazzara et al. | |
| 5,916,563 | A | 6/1999 | Young et al. | |
| 5,965,358 | A | 10/1999 | Carrion et al. | |
| 6,013,487 | A | 1/2000 | Mitchell | |
| 6,083,702 | A | 7/2000 | Mitchell et al. | |
| 6,156,303 | A | 12/2000 | Russell et al. | |
| 6,183,950 | B1 | 2/2001 | Madonna | |
| 6,583,408 | B2 | 6/2003 | Smith et al. | |
| 6,744,042 | B2 | 6/2004 | Zajfman et al. | |
| 6,753,523 | B1 | 6/2004 | Whitehouse | |
| 6,888,130 | B1 * | 5/2005 | Gonin ..... | H01J 49/027 250/281 |
| 7,314,912 | B1 | 1/2008 | Hallek et al. | |
| 7,829,842 | B2 | 11/2010 | Makarov | |
| 8,294,085 | B2 | 10/2012 | Ding | |
| 8,395,112 | B1 | 3/2013 | Bier | |
| 8,409,870 | B2 | 4/2013 | Van Wujickhuijse | |
| 9,095,793 | B2 | 8/2015 | Flagan | |
| 10,056,244 | B1 | 8/2018 | Quarmby et al. | |
| 2003/0155502 | A1 | 8/2003 | Grosshans et al. | |
| 2004/0169137 | A1 | 9/2004 | Westphall et al. | |
| 2005/0236375 | A1 | 10/2005 | Gefter et al. | |
| 2007/0254352 | A1 | 11/2007 | Schaffer et al. | |
| 2009/0020694 | A1 | 1/2009 | Flory | |
| 2009/0078866 | A1 | 3/2009 | Li et al. | |
| 2010/0084549 | A1 | 4/2010 | Ermakov et al. | |
| 2010/0084552 | A1 | 4/2010 | Kawana | |
| 2010/0090102 | A1 | 4/2010 | Rather et al. | |
| 2010/0227310 | A1 | 9/2010 | Manalis et al. | |
| 2010/0234837 | A1 | 9/2010 | Alfano | |
| 2010/0314538 | A1 | 12/2010 | Makarov et al. | |
| 2010/0320377 | A1 | 12/2010 | Cotter | |
| 2011/0095175 | A1 | 4/2011 | Bateman | |
| 2011/0240845 | A1 * | 10/2011 | Ding ..... | H01J 49/027 250/282 |
| 2012/0112056 | A1 | 5/2012 | Brucker et al. | |
| 2012/0282641 | A1 | 11/2012 | Reilly et al. | |
| 2013/0175440 | A1 | 7/2013 | Perelman et al. | |
| 2013/0124099 | A1 | 8/2013 | Ecker | |
| 2013/0200261 | A1 | 8/2013 | Mizutani et al. | |
| 2013/0234017 | A1 | 9/2013 | Kaltashov et al. | |
| 2013/0327934 | A1 | 12/2013 | Makarov et al. | |
| 2014/0197333 | A1 | 7/2014 | Jolliffe et al. | |
| 2014/0346344 | A1 | 11/2014 | Chen | |
| 2015/0008316 | A1 | 1/2015 | Guna | |
| 2015/0021472 | A1 | 1/2015 | Makarov | |
| 2015/0325425 | A1 | 11/2015 | Makarov | |
| 2015/0331000 | A1 | 11/2015 | Collier et al. | |
| 2016/0005580 | A1 | 1/2016 | Grinfeld | |
| 2016/0035556 | A1 | 2/2016 | Berkout et al. | |
| 2016/0181084 | A1 | 6/2016 | Smith | |
| 2016/0336165 | A1 * | 11/2016 | Guna ..... | H01J 49/0031 |
| 2017/0040152 | A1 | 2/2017 | Makarov | |
| 2017/0307565 | A1 | 10/2017 | Clemmer et al. | |
| 2017/0372883 | A1 | 12/2017 | Verenchikov | |
| 2020/0243317 | A1 | 7/2020 | Lopez-Hilfiker et al. | |
| 2020/0357626 | A1 * | 11/2020 | Jarrold ..... | H01J 49/025 |

FOREIGN PATENT DOCUMENTS

| | | | |
|---|---|---|---|
| WO | 2000028004 | A1 | 5/2000 |
| WO | 2000028061 | A1 | 5/2000 |
| WO | 003042704 | A1 | 5/2003 |
| WO | 2006130474 | A2 | 12/2006 |
| WO | 2010135830 | A1 | 12/2010 |
| WO | 20120083031 | A1 | 6/2012 |
| WO | 012145037 | A1 | 10/2012 |
| WO | 016073850 | A1 | 5/2016 |
| WO | 017162779 | A1 | 9/2017 |
| WO | 20170190031 | A1 | 11/2017 |
| WO | 20190140233 | A1 | 7/2019 |
| WO | 2019231854 | A1 | 12/2019 |

OTHER PUBLICATIONS

PCT International Search Report and Written Opinion completed by the ISA/EP dated Apr. 16, 2019 and issued in connection with PCT/US2019/013274.

PCT International Search Report and Written Opinion completed by the ISA/EP dated Mar. 27, 2019 and issued in connection with PCT/US2019/013277.

PCT International Search Report and Written Opinion completed by the ISA/EP dated Jul. 24, 2019 and issued in connection with PCT/US2019/013278.

PCT International Search Report and Written Opinion completed by the ISA/EP dated Mar. 28, 2019 and issued in connection with PCT/US2019/013280.

PCT International Search Report and Written Opinion completed by the ISA/EP dated Mar. 27, 2019 and issued in connection with PCT/US2019/013283.

PCT International Search Report and Written Opinion completed by the ISA/EP dated Mar. 28, 2019 and issued in connection with PCT/US2019/013284.

PCT International Search Report and Written Opinion completed by the ISA/EP dated Jul. 26, 2019 and issued in connection with PCT/US2019/013285.

PCT International Search Report and Written Opinion completed by the ISA/US dated Jan. 12, 2016 and issued in connection with PCT/US2015/059463.

Supplemental European Search Report for European Patent Application No. 17790559.3 dated Nov. 12, 2019 (11 pages).

Anthony, Staci N. "MS /MS instrumentation for megadalton-sized ions", 2016, XP055619426, ISBN 978-1-369-02558-3 Retrieved from the Internet: URL:https://search.proquest.com/docview/1830450391?accountid=29404.

Anthony, et al., A simple electrospray interface based on a DC ion carpet, Int. J. Mass Spectrom. 371, 1-7 (2014).

Bantel-Schall, U., et al., "Human Adena-Associated Virus Type 5 Is Only Distantly Related to Other Known Primate Helper-Dependent Parvoviruses", Journal of Virology, vol. 73, pp. 939-947 {Feb. 1999).

Beuhler, et al., Threshold studies of secondary electron emission induced by macro ion impact on solid surfaces. Nucl. Instrum. Methods. 170, 309-315 (1980).

Beuhler, et al., A study of the formation of high molecular weight water cluster ions {m/e < 59000) in expansion of ionized gas mixtures, J. Chem. Phys. 77, 2549-2557 (1982).

(56) References Cited

OTHER PUBLICATIONS

Brancia, et al., Digital asymmetric waveform isolation {DAWI) in a digital linear ion trap. J_Am. Soc_Mass Spectrom. 1. 1530-1533 (2010).
Brown, C., et al. "Chimeric Parvovirus B19 Capsids for the Presentation of Foreign Epitope",; Virology 198, pp. J77-488 (1994).
Burnham, et al. "Analytical Ultracentrifugation as an Approach to Characterize Recombinant Adena-Associated Viral Vectors", Human Gene Therapy Methods, vol. 26, No. 6; pp. 228-242, Oct. 15, 2015.
Chao, Hengjun, et al. "Several Log Increase in Therapeutic Transgene Delivery by Distinct Adena-Associated Viral Serotype Vectors" Molecular Therapy vol. 2, No. 6, pp. 619-623 {Dec. 2000).
Chiorini, John A., et al. "Cloning of Adeno-Associated Virus Type 4 (MV4) and Generation of Recombinant MV4 Particles",Journal of Virology, vol. 71, pp. 6823-6833 {Sep. 1997).
Chiorini, John A., "Cloning and Characterization of Adeno-Associated Virus Type 5", Journal of Virology, vol. 73, DP-1309-1319 {Feb. 1999).
Chernushevich, et al., Collisional cooling of large ions in electrospray mass spectrometry. Anal. Chem 76. H54-1760 (2004).
Cleves, Ann E., "Protein transport: The nonclassical ins and outs", Current Biology, vol. 7, No. 5, pp. 318-320 (1997).
Contino, Nathan Colby, "Ion trap charge detection mass spectrometry: Lowering limits of detection and improving signal to noise", ISBN: 9781303535048, Jul. 30, 2013 (Jul. 30, 2013).
Ding, et al., A simulation study of the digital ion trap mass spectrometer. Int. J. Mass Spectrom. 221, 117-138 {2002).
Ding, et al., A digital ion trap mass spectrometer coupled with atmospheric pressure ion sources. J_Mass Spectrom. 69, 471-484 (2004).
Douglas J_Linear quadrupoles in mass spectrometry. Mass Spectrom. Rev. 28, 937-960 (2009).
Doussineau, Tristan, et al. "Infrared multiphoton dissociation tandem charge detection-mass spectrometry of single megadalton electrosprayed ions", Review of Scientific Instruments, AIP, Melville, NY, US, vol. 82, No. 8, Aug. 1, 2011, pp. 84104-84104.
Elliott, Andrew G., et al. "Simultaneous Measurements of Mass and Collisional Cross-Section of Single Ions with charge Detection Mass Spectrometry", Analytical Chemistry, vol. 89, No. 14, Jun. 16, 2017, pp. 7701-7708.
Elliott, Andrew G., et al. "Effects of Individual Ion Energies on Charge Measurements in Fourier Transform Charge Detection Mass Spectrometry (FT-CDMS)", Journal of the American Society for Mass Spectrometry., Nov. 14, 2018 (Nov. 14, 2018).
Elliott, Andrew G., et al. "Single Particle Analyzer of Mass: A Charge Detection Mass Spectrometer with a Multi-Detector Electrostatic Ion Trap", International Journal of Mass Spectrometry, Elsevier Science Publishers, Amsterdam, NL, vol. 414, Jan. 15, 2017, pp. 45-55.
Fuerstenau, et al., "Mass Spectrometry of an Intact Virus", Agnew. Chem. 2001, 559-562.
Gao, Guangping, et al. "Clades of Adeno-Associated Viruses Are Widely Disseminated in Human Tissues", vol. 78, pp. 6381-6388 (Jun. 2004).
Gao, Guangping, et al. "Novel Adeno-Associated Viruses from Rhesus Monkeys as Vectors for Human GeneTherap",.; National Academy of Sciences, vol. 99, No. 18, pp. 11854-11859 {Sep. 3, 2002).
Gorman, Linda, et al. "Stable Alteration of Pre-mRNA Splicing Patterns by Modified U7 Small Nuclear RNAs", National Academy of Sciences, vol. 95, No. 9, pp. 4929-4934 (Apr. 28, 1998).
Grifman, M., et al. "Incorporation of Tumor-Targeting Peptides into Recombinant Adeno-associated Virus Capsids",.; Molecular Therapy, vol. 3, No. 6, pp. 964-975 (Jun. 2001).
Grinfeld, Dmitry, et al. "Space-Charge Effects in An Electrostatic Multireflection Ion Trap", European Journal of Mass Spectrometry,vol. 20, No. 2, Apr. 1, 2014 (Apr. 1, 2014), p. 131-142.
Hauck, B., et al. "Characterization of Tissue Tropism Determinants of Adeno-Associated Vims Type 1", Journal of Virology, vol. 77, No. 4, pp. 2768-2774 (Feb. 2003).
Hogan, Joanna, et al. "Optimized Electrostatic Linear Ion Trap for Charge Detection Mass Spectrometry", Jul. 9, 2018 (Jul. 9, 2018), vol. 29, No. 10, p. 2086-2095.
Keifer, David Z., "Single-Molecule Mass Spectrometry", Mass Spectrometry Reviews, vol. 36 pp. 715-733 (2017).
Keifer, David Z., et al. "Charge detection mass spectrometry: weighing heavier things" The Analyst, vol. 142, No. 10, Jan. 1, 2017, pp. 1654-1671.
Keifer, David Z., et al. "Charge Detection Mass Spectrometry with Almost Perfect Charge Accuracy", Analytical Chemistry, vol. 87, No. 20, Oct. 20, 2015, pp. 10330-10337.
Kelly, Ryan T., et al. "The ion funnel: Theory, implementations, and applications", Mass Spectrometry Reviews., vol. 29, Apr. 23, 2009, pp. 294-312.
Kim et al., A multicapillary inlet jet disruption electrodynamic ion funnel interface for improved sensitivity using tmospheric pressure ion sources. Anal. Chem. 73, 4162-4170 {2001).
Draper, Benjamin E., "The FUNPET—a New Hybrid Ion Funnel-Ion Carpet Atmospheric Pressure Interface for the Simultaneous Transmission of a Broad Mass Range", Journal of the American Society of Mass Spectrometry 29, 2160-2172, Aug. 15, 2018.
El-Baba, Tarick J., et al., "Melting Proteins Confined in Nanodroplets With 10.6 um Light Provided Clues About Early Steps of Denaturation", Chemical Communications, vol. 54, No. 26, 3270-3273, 2018.
Heller, Manfred, et al. "Mass Spectrometry-Based Analytical Tools for the Molecular Protein Characterization of Human Plasma Lipoproteins", Proteomics 2005, 5, 2619-2630.
Hutchins, Patrick M., et al. "Quantification of HDL Particle Concentration by Calibrated Ion Mobility Analysis", Clinical Chemistry 60:11, 1393-1401, 2014.
Kukreja, Alexander A., et al. "Structurally Similar Woodchuck and Human Hepadnavirus Core Proteins Having Distinctly Different Temperature Dependencies of Assembly" Journal of Virology, vol. 68, No. 24, 14105-14115, Sep. 24, 2014.
PCT International Search Report and Written Opinion completed by the ISA/EP dated Sep. 9, 2019 and issued in connection with PCT/US2020/035379.
PCT International Search Report and Written Opinion completed by the ISA/EP dated Aug. 27, 2019 and issued in connection with PCT/US2019/035381.
PCT International Search Report and Written Opinion completed by the ISA/EP dated Mar. 8, 2021 and issued in connection with PCT/US2020/065300.
PCT International Search Report and Written Opinion completed by the ISA/EP dated Mar. 8, 2021 and issued in connection with PCT/US2020/065301.
PCT International Search Report and Written Opinion completed by the ISA/US dated Apr. 5, 2021 and issued in connection with PCT/US2021/016435.
PCT International Search Report and Written Opinion completed by the ISA/US dated Mar. 18, 2021 and issued in connection with PCT/US2021/016325.
Botamanenko, Daniel, et al., "Ion-Ion Interactions in Charge Detection Mass Spectrometry", J Am Soc Mass Spectrom. Dec. 2019 ; 30(12): 2741-2749. doi:10.1007/s13361-019-02343-y.
Draper, Benjamin E., et al., "Real-Time Analysis and Signal Optimization for Charge Detection Mass Spectrometry", J. Am. Soc. Mass Spectrom. (2019) 30:898Y904.
Todd, Aaron R., et al. "Implementation of a Charge-Sensitive Amplifier without a Feedback Resistor for Charge Detection Mass Spectrometry Reduces Noise and Enables Detection of Individual Ions Carrying a Single Charge", J. Am. Soc. Mass Spectrom. 2020, 31, 146-154.
PCT International Search Report and Written Opinion completed by the ISA/EP dated Jul. 14, 2020 and issued in connection with PCT/US2020/029287.
PCT International Search Report and Written Opinion completed by the ISA/US dated Nov. 23, 2020 and issued in connection with PCT/US2020/052009.
PCT International Search Report and Written Opinion completed by the ISA/US dated Jan. 24, 2021 and issued in connection with PCT/US2020/054975.

(56) References Cited

OTHER PUBLICATIONS

Koizumi et al., A novel phase-coherent programmable clock for high-precision arbitrary waveform generation applied to digital ion trap mass spectrometry_Int. J_Mass Spectrom_292, 23-31 (2010).
Konenkov et al., Matrix methods for the calculation of stability diagrams in quadrupole mass spectrometry. J. Amer. Soc. Mass Spec. 13, 597-613 {2002).
Landais et al., Varying the radio frequency: A new scanning mode for quadrupole analyzers. Rapid Commun. Mass Spectrom. 12, 302-306 (1998).
Makarov, Alexander, "Electrostatic Axially Harmonic Orbital Trapping: A High-Performance Technique of Mass Analysis", Analytical Chemistry, vol. 72, No. 6, Mar. 1, 2000 (Mar. 1, 2000), p. 1156-1162.
Marmet et al., A frequency-swept quadrupole mass filler. Int. J_Mass Spectrom. Ion Proc. 42, 3-10 (1982).
Martin, Stability of doubly charged alkali halide clusters. J_Chem. Phys. 76, 5467-5469 (1982).
Miyamura, K., et al. "Parvovirus Particles as Platforms for Protein Presentation", National Academy of Sciences, vol. 1,No. 18,pp. 8507-8511 (Aug. 30, 1994).
Mori, Seiichiro, Mori, et al. "Two novel adeno-associated viruses from cynomolgus monkey: pseudotyping characterization of capsid protein", Virology 330, pp. 375-383 (2004).
Muzyczka, N., "Use of Adeno-Associated Virus as a General Transduction Vector for Mammalian Cells", Current Topics n Microbiology and Immunology, vol. 158, pp. 97-129 (1992).
Muramatsu, S., et al. "Nucleotide Sequencing and Generation of an Infectious Clone of Adeno-Associated Virus 3", Virology vol. 221; Article No. 0367; pp. 208-217 (1996).
Padron, Eric, et al. "Structure of Adeno-Associated Virus Type 4", Journal of Virology, vol. 79, No. 8, pp. 5047-5058 Apr. 2005).
Puttaraju, M., et al. "Spliceosome-mediated RNA trans-splicing as a tool for gene therapy", Nature Biotechnology, vol. 17, pp. 246-252 (Mar. 1999).
Nie et al., Frequency scan of a quadrupole mass analyzer in the third stability region for protein analysis. J. Chin. Chem_Soc., 53, 47-52 (2006).
Paul et al., Das elektrische massenfilter als massenspektromeler und isotopenlrenner. Z. Phys. 152, 143-182 (1958).
Paul, et al., Das elektrische massenfiller, Z. Phys. 140, 262-273 (1955).
Pierson, Elizabeth E., et al., "Detection of 1-15 Late Intermediates in Virus Capsid Assembly by Charge Detection Mass Spectrometry", Journal of the American Chemical Society, vol. 136, No. 9, Feb. 19, 2014, 3536-3541.
Pierson, Elizabeth E., et al., Charge Detection Mass Spectrometry for Single Ions with an Uncertainty in the Charge Measurement of 0.65 e; Elizabeth E_Pierson et al.; Journal American Society for Mass Spectrometry, vol. 26, pp. 1213-1220 (2015).
Pierson, Elizabeth E., et al. "Charge Detection Mass Spectrometry Identifies Preferred Non-icosahedral Polymorphs in the Self-Assembly of Woodchuck Hepatitis Virus Capsids", Jour. of Molecular Biology, vol. 428, Issue 2, pp. 292-300. Jan. 29, 2016.
Schlunegger et al., Frequency scan for the analysis of high mass ions generated by matrix-assisted laser esorption/ionization in a Paul trap_Rapid Commun. Mass Spectrom. 13, 1792-1796 (1999).
Richards et al., A new operating mode for the quadrupole mass filler. Int. J. Mass Spectrom. Ion Phys. 12, 317-339 1973).
Richards et al., Waveform parameter tolerances for the quadrupole mass filler with rectangular excitation. Int. J. Mass Spectrom. Ion Phys_15, 417-428 (1974).
Sonalikar, Hrishikesh S., et al. "Numerical analysis of segmented-electrode Orbitraps", International Journal of Mass Spectrometry, Elsevier Science Publishers, Amsterdam, NL,vol. 395, Dec. 17, 2015 (Dec. 17, 2015), p. 36-48.
Shinholt, Review of Scientific Instruments. 85, 113109 (2014); doi: 10.1063/1.4900627.
Sobott et al., A tandem mass spectrometer for improved transmission and analysis of large macromolecular Assemblies. Anal. Chem. 74, 1402-1407 (2002).
Syed, et al., Quadrupole mass filler Design and performance for operation in stability zone 3. J. Am. Soc. Mass Spectrom. 24, 1493-1500 (2013).
Shade, Rosemary, et al. "Nucleotide Sequence and Genome Organization of Human Parvovirus B19 Isolated from the Serum of a Child during plastic Crisis", Journal of Virology, vol. 58, No. 3, pp. 921-936 {Jun. 1986).
Sharp, Phillip A., et al. "RNA Interference", American Association for the Advancement of Science; Science, New Series, vol. 287, No. 5462, pp. 2431-2433 {Mar. 31, 2000).
Shi, Z., et al. "Insertional Mutagenesis at Positions 520 and 584 of Adena-Associated Virus Type 2 (MV2) Capsid Gene and Generation of MV2 Vectors with Eliminated Heparin-Binding Ability and Introduced Novel Tropism", Human Gene Therapy, vol. 17, pp. 353-361 (Mar. 2006).
Srivastava, Arun, et al., "Nucleotide Sequence and Organization of the Adena-Associated Virus 2 Genome", Journal of Virology, vol. 45, No. 2, pp. 555-564 {Feb. 1983).
Tsao, Jun, et al., "The Three-Dimensional Structure of Canine Parvovirus and Its Functional Implications", American Association for the Advancement of Science, Science, New Series, vol. 251, No. 5000, pp. 1456-1464 {Mar. 22, 991).
Walters, Robert W., "Structure of Adeno-Associated Virus Serotype 5", Journal of Virology, vol. 78, No. 7, pp. B361-3371 {Apr. 2004).
Wang, Lei, et al., "Expanding the Genetic Code", Annual Review of Biophysics and Biomolecular Structure, vol. 35, pp. 25-249 {2006).
Xie, Qing, et al., "Canine Parvovirus Capsid Structure, Analyzed at 2.9 A Resolution", Journal of Molecular Biology, vol. 64, pp. 497-520 (1996).
Xie, Qing, et al., "The atomic structure of adeno-associated virus (MV-2), a vector for human gene therapy", PNAS, vol. 99, No. 16, pp. 10405-10410 (Aug. 6, 2002).
Xiao, Weidong, et al., "Gene Therapy Vectors Based on Adena-Associated Virus Type 1", Journal of Virology, vol. 73, No. 5, pp. 3994-4003 (May 1999).
Uetrecht et al., "Stability and Shape of Hepatitis B Virus Capsids In Vacuo", Angew. Chem. Int. Ed. 2008, 47, 6247-6251.
Uetrecht et al., "High-resolution mass spectrometry of viral assemblies: Molecular composition and stability of dimorphic hepatitis B virus capsids", PNAS 2008, vol. 105, 9216-9920.
Winger, et al., Observation and implications of high mass-lo-charge ratio ions from electrospray ionization mass spectrometry, J_Am_Soc_Mass Spectrom. 4, 536-545 (1993).
Xiong, et al., The development of charge detection-quadrupole ion trap mass spectrometry driven by rectangular and triangularwaves, Analyst 137, 1199-1204 (2012).
Yang, et al., Development of a palm portable mass spectrometer. J. Amer. Soc. Mass Spec. 19, 1442-1448 (2008).
Yost, et al., Selected ion fragmentation with a tandem quadrupole mass spectrometer. J. Am. Chem. Soc. 100, 274-2275 (1978).
Charge Detection Mass Spectrometry of Bacteriophage P22 Procapsid Distributions Above 20MDa, David Keifer et al., Rapid Communications in Mass Spectrometry, vol. 28, No. 5 , Mar. 2005.
Charge Detection Mass Spectrometry: Instrumentation & Applications to Viruses, Elizabeth Pierson, Proquest Dissertationsand Theses; Thesis (PhD.) vol. 76-09(E), Section: B. 168 , May 2015.
Defining the Stoichiometry and Cargo Load of Viral and Bacterial Nanoparticles by Orbitrap Mass Spectrometry, Snijder, J. et al., J Am. Chem. Soc 2014, 136, 7295-7299.
Analysis of a Common Cold Virus and Its Subviral Particles by Gas-Phase Electrophoretic Mobility Molecular Analysis and Native Mass Spectrometry, Weiss VU et al., Anal Chern. 2015.
Product-Related Impurities in Clinical-Grade Recombinant AAV Vectors: Characterization and Risk Assessment, J Fraser Wright, Biomedicines 2014, 2, 80-97.
European Office Action dated Sep. 2, 2021 in application 19 707 901.5.

* cited by examiner

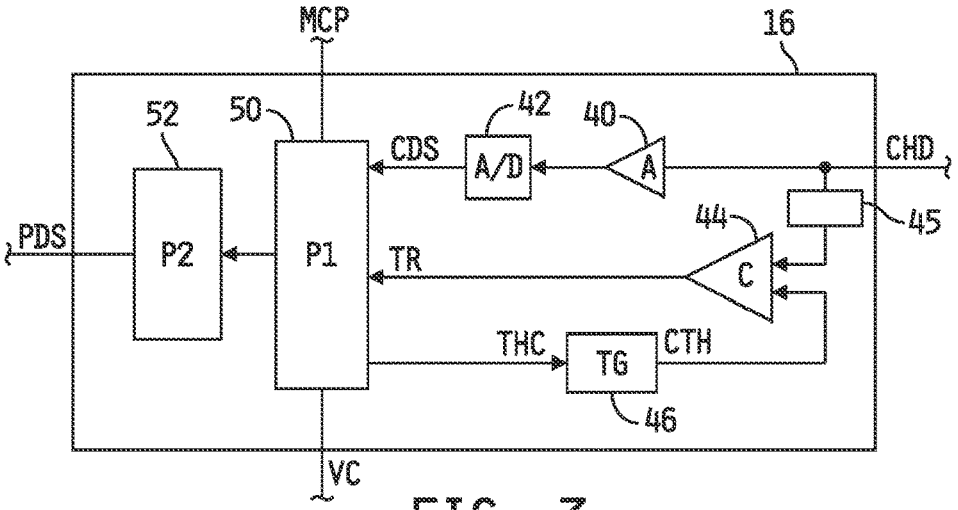
FIG. 3
FIG. 4A
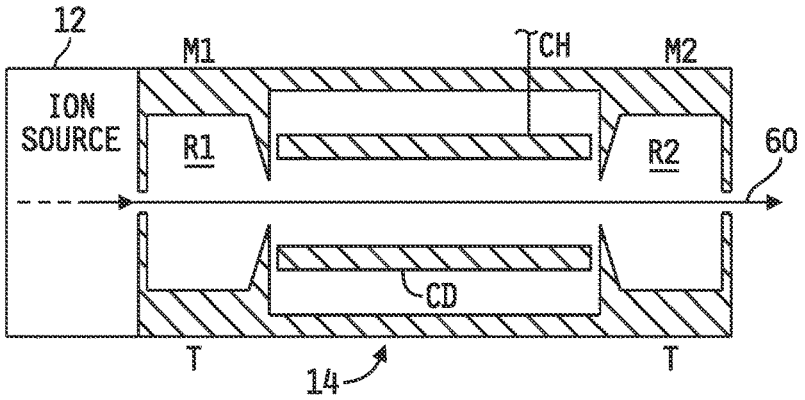
FIG. 4B
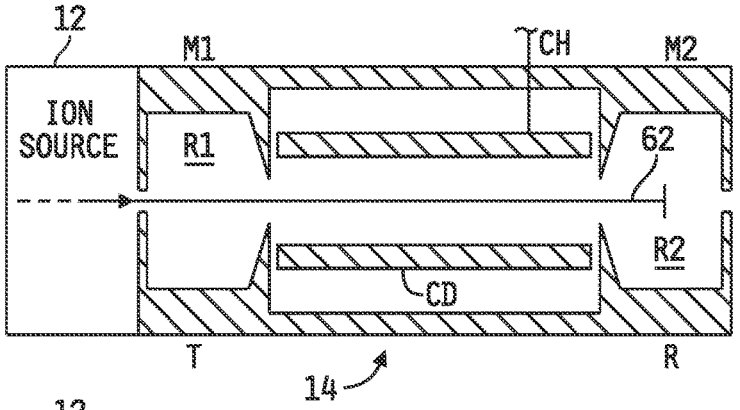
FIG. 4C
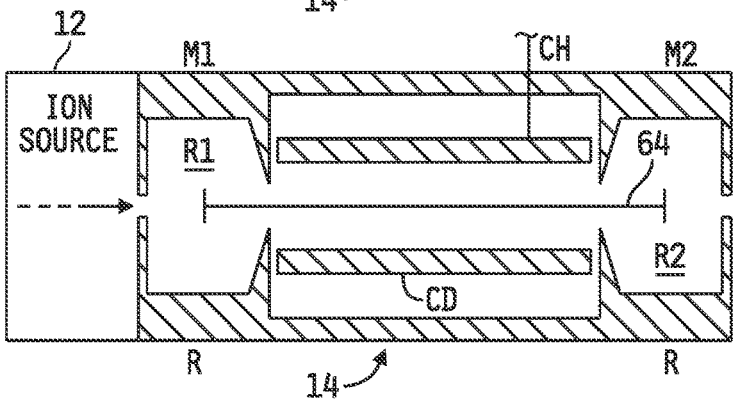

APPARATUS AND METHOD FOR CAPTURING IONS IN AN ELECTROSTATIC LINEAR ION TRAP

CROSS-REFERENCE TO RELATED APPLICATIONS

This application is a U.S. national stage entry of PCT Application No. PCT/US2019/013280, filed Jan. 11, 2019, which claims the benefit of and priority to U.S. Provisional Patent Application Ser. No. 62/680,296, filed Jun. 4, 2018, the disclosures of which are incorporated herein by reference in their entireties.

GOVERNMENT RIGHTS

This invention was made with government support under CHE1531823 awarded by the National Science Foundation. The United States Government has certain rights in the invention.

TECHNICAL FIELD

The present disclosure relates generally to charge detection mass spectrometry instruments, and more specifically to performing mass and charge measurements with such instruments.

BACKGROUND

Mass Spectrometry provides for the identification of chemical components of a substance by separating gaseous ions of the substance according to ion mass and charge. Various instruments and techniques have been developed for determining the masses of such separated ions, and one such technique is known as charge detection mass spectrometry (CDMS). In CDMS, ion mass is determined as a function of measured ion mass-to-charge ratio, typically referred to as "m/z," and measured ion charge.

High levels of uncertainty in m/z and charge measurements with early CDMS detectors has led to the development of an electrostatic linear ion trap (ELIT) detector in which ions are made to oscillate back and forth through a charge detection cylinder. Multiple passes of ions through such a charge detection cylinder provides for multiple measurements for each ion, and it has been shown that the uncertainty in charge measurements decreases with $n^{1/2}$, where n is the number of charge measurements. However, spurious, extraneous and/or other charges picked up on the charge detector can present challenges to distinguishing valid and detectable charges from charge detector noise, and this effect becomes even more pronounced as charge signal levels approach the noise floor of the charge detector. Accordingly, it is desirable to seek improvements in ELIT design and/or operation which extend the range of valid, detectable charge measurements over those obtainable using current ELIT designs.

SUMMARY

The present disclosure may comprise one or more of the features recited in the attached claims, and/or one or more of the following features and combinations thereof. In a first aspect, a system for trapping ions for measurement thereof may comprise an electrostatic linear ion trap (ELIT), a source of ions configured to supply ions to the ELIT, a processor operatively coupled to the ELIT, and a memory having instructions stored therein which, when executed by the at least one processor, cause the at least one processor to (i) produce at least one control signal to open the ELIT to allow ions supplied by the source of ions to enter the ELIT, (ii) determine an ion inlet frequency corresponding to a frequency of ions flowing from the source of ions into the open ELIT, (iii) generate or receive a target ion charge value, (iv) determine an optimum threshold value as a function of the target ion charge value and the determined ion inlet frequency, and (v) produce at least one control signal to close the ELIT when a charge of an ion within the ELIT exceeds the optimum threshold value to thereby trap the ion in the ELIT.

In a second aspect, a method is provided for trapping in an electrostatic linear ion trap (ELIT) ions supplied by a source of ions for measurement thereof. The method may comprise (i) producing, with a processor, at least one control signal to open the ELIT to allow ions supplied by the source of ions to enter the ELIT, (ii) determining, with the processor, an ion inlet frequency corresponding to a frequency of ions flowing from the source of ions into the open ELIT, (iii) generating or receiving, with the processor, a target ion charge value, (iv) determining, with the processor, an optimum threshold value as a function of the target ion charge value and the determined ion inlet frequency, and (v) producing, with the processor, at least one control signal to close the ELIT when a charge of an ion within the ELIT exceeds the optimum threshold value to thereby trap the ion in the ELIT.

In a third aspect, a system for separating ions may comprise the ion trapping system described in either of the above aspects, wherein the source of ions is configured to generate ions from a sample, and at least one ion separation instrument configured to separate the generated ions as a function of at least one molecular characteristic, wherein ions exiting the at least one ion separation instrument are supplied to the ELIT.

In a fourth aspect, a system for separating ions may comprise an ion source configured to generate ions from a sample, a first mass spectrometer configured to separate the generated ions as a function of mass-to-charge ratio, an ion dissociation stage positioned to receive ions exiting the first mass spectrometer and configured to dissociate ions exiting the first mass spectrometer, a second mass spectrometer configured to separate dissociated ions exiting the ion dissociation stage as a function of mass-to-charge ratio, and the system described above in the third aspect coupled in parallel with and to the ion dissociation stage such that the system of the third aspect can receive ions exiting either of the first mass spectrometer and the ion dissociation stage, wherein the system of the third aspect is a charge detection mass spectrometer (CDMS), wherein masses of precursor ions exiting the first mass spectrometer are measured using the CDMS, mass-to-charge ratios of dissociated ions of precursor ions having mass values below a threshold mass are measured using the second mass spectrometer, and mass-to-charge ratios and charge values of dissociated ions of precursor ions having mass values at or above the threshold mass are measured using the CDMS.

BRIEF DESCRIPTION OF THE DRAWINGS

FIG. 3 is a simplified diagram of an embodiment of the processor 16 illustrated in FIG. 1.

FIGS. 4A-4C are simplified diagrams of the ELIT of FIG. 1 demonstrating sequential control and operation of the ion mirrors and of the charge generator to capture at least one ion within the ELIT and to cause the ion(s) to oscillate back and forth between the ion mirrors and through the charge detection cylinder to measure and record multiple charge detection events.

DESCRIPTION OF THE ILLUSTRATIVE EMBODIMENTS

For the purposes of promoting an understanding of the principles of this disclosure, reference will now be made to a number of illustrative embodiments shown in the attached drawings and specific language will be used to describe the same.

This disclosure relates to an electrostatic linear ion trap (ELIT) and an apparatus and method for selecting and modifying a charge detection threshold during trigger trapping operation thereof to facilitate trapping in the ELIT of weakly-charge ions, i.e., ions with low charge magnitudes. For purposes of this disclosure, the phrase "charge detection event" is defined as detection of a charge associated with an ion passing a single time through a charge detector of the ELIT, and the phrase "ion measurement event" is defined as a collection of charge detection events resulting from oscillation of an ion back and forth through the charge detector a selected number of times or for a selected time period.

Figure 1:
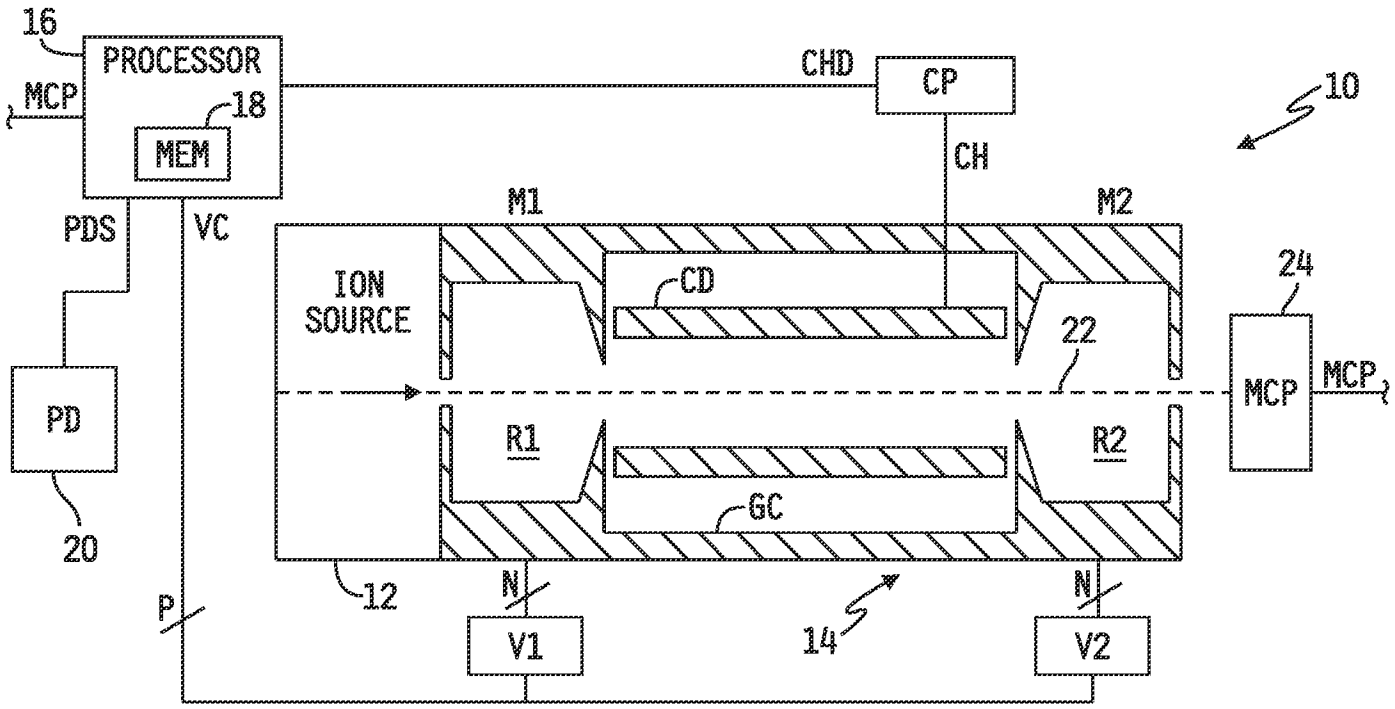
FIG. 1 is a simplified diagram of an ion mass detection system including an embodiment of an electrostatic linear ion trap (ELIT) with control and measurement components coupled thereto.

Referring to FIG. 1, charge detection mass spectrometer (CDMS) 10 is shown including an embodiment of an electrostatic linear ion trap (ELIT) 14 with control and measurement components coupled thereto. In the illustrated embodiment, the CDMS 10 includes an ion source 12 operatively coupled to an inlet of the ELIT 14. As will be described further with respect to FIG. 7A, the ion source 12 illustratively includes any conventional device or apparatus for generating ions from a sample and may further include one or more devices and/or instruments for separating, collecting, filtering, fragmenting and/or normalizing or shifting charge states of ions according to one or more molecular characteristics. As one illustrative example, which should not be considered to be limiting in any way, the ion source 12 may include a conventional electrospray ionization source, a matrix-assisted laser desorption ionization (MALDI) source or the like, coupled to an inlet of a conventional mass spectrometer. The mass spectrometer may be of any conventional design including, for example, but not limited to a time-of-flight (TOF) mass spectrometer, a reflectron mass spectrometer, a Fourier transform ion cyclotron resonance (FTICR) mass spectrometer, a quadrupole mass spectrometer, a triple quadrupole mass spectrometer, a magnetic sector mass spectrometer, or the like. In any case, the ion outlet of the mass spectrometer is operatively coupled to an ion inlet of the ELIT 14. The sample from which the ions are generated may be any biological or other material.

In the illustrated embodiment, the ELIT 14 illustratively includes a charge detector CD surrounded by a ground chamber or cylinder GC and operatively coupled to opposing ion mirrors M1, M2 respectively positioned at opposite ends thereof. The ion mirror M1 is operatively positioned between the ion source 12 and one end of the charge detector CD, and ion mirror M2 is operatively positioned at the opposite end of the charge detector CD. Each ion mirror M1, M2 defines a respective ion mirror region R1, R2 therein. The regions R1, R2 of the ion mirrors M1, M2, the charge detector CD, and the spaces between the charge detector CD and the ion mirrors M1, M2 together define a longitudinal axis 22 centrally therethrough which illustratively represents an ideal ion travel path through the ELIT 14 and between the ion mirrors M1, M2 as will be described in greater detail below.

In the illustrated embodiment, voltage sources V1, V2 are electrically connected to the ion mirrors M1, M2 respectively. Each voltage source V1, V2 illustratively includes one or more switchable DC voltage sources which may be controlled or programmed to selectively produce a number, N, programmable or controllable voltages, wherein N may be any positive integer. Illustrative examples of such voltages will be described below with respect to FIGS. 2A and 2B to establish one of two different operating modes of each of the ion mirrors M1, M2 as will be described in detail below. In any case, ions move within the ELIT 14 along the longitudinal axis 22 extending centrally through the charge detector CD and the ion mirrors M1, M2 under the influence of electric fields selectively established by the voltage sources V1, V2.

The voltage sources V1, V2 are illustratively shown electrically connected by a number, P, of signal paths to a conventional processor 16 including a memory 18 having instructions stored therein which, when executed by the processor 16, cause the processor 16 to control the voltage sources V1, V2 to produce desired DC output voltages for selectively establishing ion transmission and ion reflection electric fields, TEF, REF respectively, within the regions R1, R2 of the respective ion mirrors M1, M2. P may be any positive integer. In some alternate embodiments, either or both of the voltage sources V1, V2 may be programmable to selectively produce one or more constant output voltages. In other alternative embodiments, either or both of the voltage sources V1, V2 may be configured to produce one or more time-varying output voltages of any desired shape. It will be understood that more or fewer voltage sources may be electrically connected to the mirrors M1, M2 in alternate embodiments.

The charge detector CD is illustratively provided in the form of an electrically conductive cylinder which is electrically connected to a signal input of a charge sensitive preamplifier CP, and the signal output of the charge preamplifier CP is electrically connected to the processor 16. With an ion trapped within the ELIT 14 and oscillating back and forth between the ion mirrors M1, M2 as will be described in further detail below, the charge preamplifier CP is illustratively operable in a conventional manner to detect a charge (CH) induced on the charge detection cylinder CD as the ion passes therethrough between the ion mirrors M1, M2, to produce a charge detection signal (CHD) corresponding thereto and to supply the charge detection signal CHD to the processor 16. The processor 16 is, in turn, illustratively operable to receive and digitize the charge detection signal CHD produced by the charge preamplifier CP, and to store the digitized charge detection signal CHD in the memory 18.

The processor 16 is further illustratively coupled to one or more peripheral devices 20 (PD) for providing peripheral device signal input(s) (PDS) to the processor 16 and/or to which the processor 16 provides signal peripheral device signal output(s) (PDS). In some embodiments, the peripheral devices 20 include at least one of a conventional display monitor, a printer and/or other output device, and in such embodiments the memory 18 has instructions stored therein which, when executed by the processor 16, cause the processor 16 to control one or more such output peripheral devices 20 to display and/or record analyses of stored, digitized charge detection signals. In some embodiments, a conventional ion detector 24, e.g., in the form of one or more microchannel plate detectors, is positioned adjacent to the ion exit aperture of the ion mirror M2, and at least one output of the ion detector 24 is electrically connected to the processor 16. The ion detector 24 is operable in a conventional manner to detect ions exiting the ion mirror M2 of the ELIT 14 and to provide corresponding ion detection signal MCP to the processor 16. As will be described in greater detail below, ion detection information provided by the detector 24 to the processor 16 may be used to facilitate adjustment one or more of the components and/or operating conditions of the ELIT 14 to ensure adequate detection of ions passing through the charge detection cylinder CD.

The voltage sources V1, V2 are illustratively controlled in a manner, as described in detail below, which selectively traps an ion entering the ELIT 14 and causes the trapped ion to oscillate back and forth between the ion mirrors M1, M2 such that it repeatedly passes through the charge detection cylinder CD. A plurality of charge and oscillation period values are measured at the charge detector CD, and the recorded results are processed to determine mass-to-charge ratio, charge and mass values of the ion trapped in the ELIT 14.

Figure 2A:
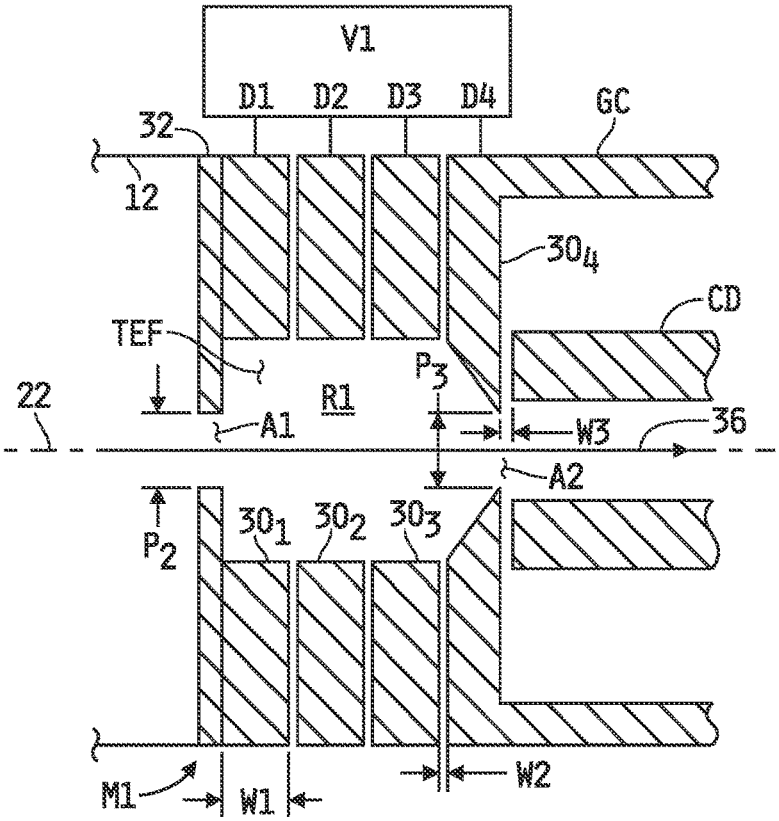
FIG. 2A is a magnified view of the ion mirror M1 of the ELIT illustrated in FIG. 1 in which the mirror electrodes of M1 are controlled to produce an ion transmission electric field therein.
Figure 2B:
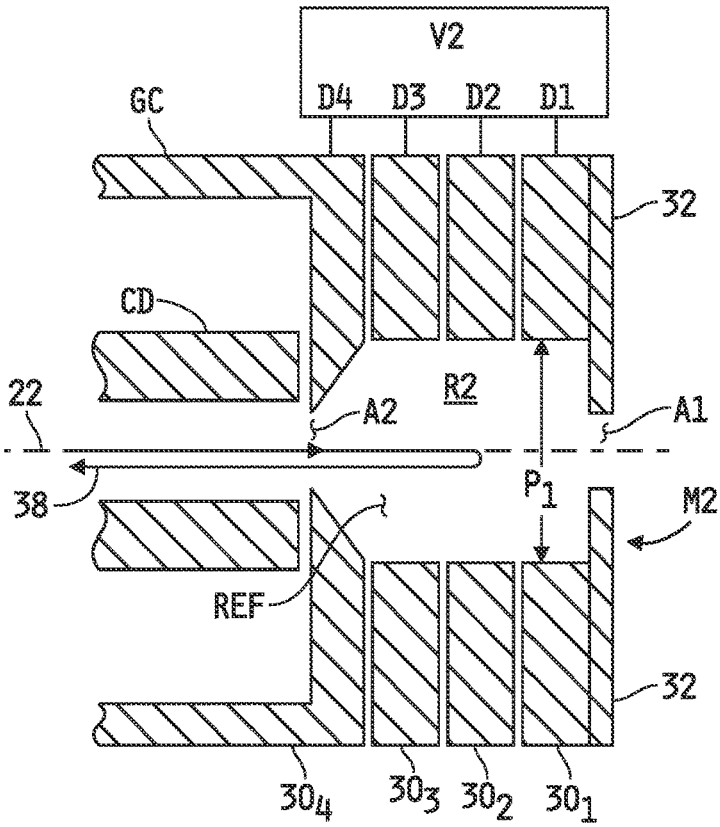
FIG. 2B is a magnified view of the ion mirror M2 of the ELIT illustrated in FIG. 1 in which the mirror electrodes of M2 are controlled to produce an ion reflection electric field therein.

Referring now to FIGS. 2A and 2B, embodiments are shown of the ion mirrors M1, M2 respectively of the ELIT 14 depicted in FIG. 1. Illustratively, the ion mirrors M1, M2 are identical to one another in that each includes a cascaded arrangement of 4 spaced-apart, electrically conductive mirror electrodes. For each of the ion mirrors M1, M2, a first mirror electrode $\mathbf{30}_1$ has a thickness W1 and defines a passageway centrally therethrough of diameter P1. An endcap 32 is affixed or otherwise coupled to an outer surface of the first mirror electrode $\mathbf{30}_1$ and defines an aperture A1 centrally therethrough which serves as an ion entrance and/or exit to and/or from the corresponding ion mirror M1, M2 respectively. In the case of the ion mirror M1, the endcap 32 is coupled to, or is part of, an ion exit of the ion source 12 illustrated in FIG. 1. The aperture A1 for each endcap 32 illustratively has a diameter P2.

A second mirror electrode $\mathbf{30}_2$ of each ion mirror M1, M2 is spaced apart from the first mirror electrode $\mathbf{30}_1$ by a space having width W2. The second mirror electrode $\mathbf{30}_2$, like the mirror electrode $\mathbf{30}_1$, has thickness W1 and defines a passageway centrally therethrough of diameter P2. A third mirror electrode $\mathbf{30}_3$ of each ion mirror M1, M2 is likewise spaced apart from the second mirror electrode $\mathbf{30}_2$ by a space of width W2. The third mirror electrode $\mathbf{30}_2$ has thickness W1 and defines a passageway centrally therethrough of width P1.

A fourth mirror electrode $\mathbf{30}_4$ is spaced apart from the third mirror electrode $\mathbf{30}_3$ by a space of width W2. The fourth mirror electrode $\mathbf{30}_4$ illustratively has a thickness of W1 and is formed by a respective end of the ground cylinder, GC disposed about the charge detector CD. The fourth mirror electrode $\mathbf{30}_4$ defines an aperture A2 centrally therethrough which is illustratively conical in shape and increases linearly between the internal and external faces of the ground cylinder GC from a diameter P3 defined at the internal face of the ground cylinder GC to the diameter P1 at the external face of the ground cylinder GC (which is also the internal face of the respective ion mirror M1, M2).

The spaces defined between the mirror electrodes $\mathbf{30}_1$-$\mathbf{30}_4$ may be voids in some embodiments, i.e., vacuum gaps, and in other embodiments such spaces may be filled with one or more electrically non-conductive, e.g., dielectric, materials. The mirror electrodes $\mathbf{30}_1$-$\mathbf{30}_4$ and the endcaps 32 are axially aligned, i.e., collinear, such that a longitudinal axis 22 passes centrally through each aligned passageway and also centrally through the apertures A1, A2. In embodiments in which the spaces between the mirror electrodes $\mathbf{30}_1$-$\mathbf{30}_4$ include one or more electrically non-conductive materials, such materials will likewise define respective passageways therethrough which are axially aligned, i.e., collinear, with the passageways defined through the mirror electrodes $\mathbf{30}_1$-$\mathbf{30}_4$ and which illustratively have diameters of P2 or greater. Illustratively, P1>P3>P2, although in other embodiments other relative diameter arrangements are possible.

A region R1 is defined between the apertures A1, A2 of the ion mirror M1, and another region R2 is likewise defined between the apertures A1, A2 of the ion mirror M2. The regions R1, R2 are illustratively identical to one another in shape and in volume.

As described above, the charge detector CD is illustratively provided in the form of an elongated, electrically conductive cylinder positioned and spaced apart between corresponding ones of the ion mirrors M1, M2 by a space of width W3. In one embodiment, W1>W3>W2, and P1>P3>P2, although in alternate embodiments other relative width arrangements are possible. In any case, the longitudinal axis 22 illustratively extends centrally through the passageway defined through the charge detection cylinder CD, such that the longitudinal axis 22 extends centrally through the combination of the passageways defined by the regions R1, R2 of the ion mirrors M1, M2 and the passageway defined through the charge detection cylinder CD. In operation, the ground cylinder GC is illustratively controlled to ground potential such that the fourth mirror electrode $30_4$ of each ion mirror M1, M2 is at ground potential at all times. In some alternate embodiments, the fourth mirror electrode $30_4$ of either or both of the ion mirrors M1, M2 may be set to any desired DC reference potential, or to a switchable DC or other time-varying voltage source.

In the embodiment illustrated in FIGS. 2A and 2B, the voltage sources V1, V2 are each configured to each produce four DC voltages D1-D4, and to supply the voltages D1-D4 to a respective one of the mirror electrodes $30_1$-$30_4$ of the respective ion mirror M1, M2. In some embodiments in which one or more of the mirror electrodes $30_1$-$30_4$ is to be held at ground potential at all times, the one or more such mirror electrodes $30_1$-$30_4$ may alternatively be electrically connected to the ground reference of the respective voltage supply V1, V2 and the corresponding one or more voltage outputs D1-D4 may be omitted. Alternatively or additionally, in embodiments in which any two or more of the mirror electrodes $30_1$-$30_4$ are to be controlled to the same non-zero DC values, any such two or more mirror electrodes $30_1$-$30_4$ may be electrically connected to a single one of the voltage outputs D1-D4 and superfluous ones of the output voltages D1-D4 may be omitted.

Each ion mirror M1, M2 is illustratively controllable and switchable, by selective application of the voltages D1-D4, between an ion transmission mode (FIG. 2A) in which the voltages D1-D4 produced by the respective voltage source V1, V2 establishes an ion transmission electric field (TEF) in the respective region R1, R2 thereof, and an ion reflection mode (FIG. 2B) in which the voltages D1-D4 produced by the respect voltage source V1, V2 establishes an ion reflection electric field (REF) in the respective region R1, R2 thereof. As illustrated by example in FIG. 2A, once an ion from the ion source 12 flies into the region R1 of the ion mirror M1 through the inlet aperture A1 of the ion mirror M1, the ion is focused toward the longitudinal axis 22 of the ELIT 14 by an ion transmission electric field TEF established in the region R1 of the ion mirror M1 via selective control of the voltages D1-D4 of V1. As a result of the focusing effect of the transmission electric field TEF in the region R1 of the ion mirror M1, the ion exiting the region R1 of the ion mirror M1 through the aperture A2 of the ground chamber GC attains a narrow trajectory 36 into and through the charge detection cylinder CD that is close to the longitudinal axis 22. An identical ion transmission electric field TEF may be selectively established within the region R2 of the ion mirror M2 via like control of the voltages D1-D4 of the voltage source V2. In the ion transmission mode, an ion entering the region R2 from the charge detection cylinder CD via the aperture A2 of M2 is focused toward the longitudinal axis 22 by the ion transmission electric field TEF within the region R2 so that the ion exits the ion mirror M2 through the aperture A1 thereof.

As illustrated by example in FIG. 2B, an ion reflection electric field REF established in the region R2 of the ion mirror M2 via selective control of the voltages D1-D4 of V2 acts to decelerate and stop an ion entering the ion region R2 from the charge detection cylinder CD via the ion inlet aperture A2 of M2, to accelerate the ion in the opposite direction back through the aperture A2 of M2 and into the end of the charge detection cylinder CD adjacent to M2 as depicted by the ion trajectory 38, and to focus the ion toward the central, longitudinal axis 22 within the region R2 of the ion mirror M2 so as to maintain a narrow trajectory of the ion back through the charge detector CD toward the ion mirror M1. An identical ion reflection electric field REF may be selectively established within the region R1 of the ion mirror M1 via like control of the voltages D1-D4 of the voltage source V1. In the ion reflection mode, an ion entering the region R1 from the charge detection cylinder CD via the aperture A2 of M1 is decelerated and stopped by the ion reflection electric field REF established within the region R1, then accelerated in the opposite direction back through the aperture A2 of M1 and into the end of the charge detection cylinder CD adjacent to M1, and focused toward the central, longitudinal axis 22 within the region R1 of the ion mirror M1 so as to maintain a narrow trajectory of the ion back through the charge detector CD and toward the ion mirror M2. An ion that traverses the length of the ELIT 14 and is reflected by the ion reflection electric field REF in the ion regions R1, R2 in a manner that enables the ion to continue traveling back and forth through the charge detection cylinder CD between the ion mirrors M1, M2 as just described is considered to be trapped within the ELIT 14.

Example sets of output voltages D1-D4 produced by the voltage sources V1, V2 respectively to control a respective one of the ion mirrors M1, M2 to the ion transmission and reflection modes described above are shown in TABLE I below. It will be understood that the following values of D1-D4 are provided only by way of example, and that other values of one or more of D1-D4 may alternatively be used.

TABLE I

| Ion Mirror Operating Mode | Output Voltages (volts DC) |
|---|---|
| Transmission | V1: D1 = 0, D2 = 95, D3 = 135, D4 = 0 |
| | V2: D1 = 0, D2 = 95, D3 = 135, D4 = 0 |
| Reflection | V1: D1 = 190, D2 = 125, D3 = 135, D4 = 0 |
| | V2: D1 = 190, D2 = 125, D3 = 135, D4 = 0 |

While the ion mirrors M1, M2 and the charge detection cylinder CD are illustrated in FIGS. 1-2B as defining cylindrical passageways therethrough, it will be understood that in alternate embodiments either or both of the ion mirrors M1, M2 and/or the charge detection cylinder CD may define non-cylindrical passageways therethrough such that one or more of the passageway(s) through which the longitudinal axis 22 centrally passes represents a cross-sectional area and profile that is not circular. In still other embodiments, regardless of the shape of the cross-sectional profiles, the cross-sectional areas of the passageway defined through the ion mirror M1 may be different from the passageway defined through the ion mirror M2.

Referring now to FIG. 3, an embodiment is shown of the processor 16 illustrated in FIG. 1. In the illustrated embodiment, the processor 16 includes a conventional amplifier circuit 40 having an input receiving the charge detection signal CHD produced by the charge preamplifier CP and an output electrically connected to an input of a conventional Analog-to-Digital (A/D) converter 42. An output of the A/D converter 42 is electrically connected to a first processor 50 (P1). The amplifier 40 is operable in a conventional manner to amplify the charge detection signal CHD produced by the charge preamplifier CP, and the A/D converter is, in turn, operable in a conventional manner to convert the amplified charge detection signal to a digital charge detection signal CDS. The processor 50 is, in the illustrated embodiment, operable to store the charge detection signals CDS for each charge detection event in an ion measurement event such that an ion measurement event record stored in the processing circuit 50 includes multiple charge detection event measurements.

The processor 16 illustrated in FIG. 3 further includes a conventional comparator 44 having a first input receiving the charge detection signal CHD produced by the charge preamplifier CP, a second input receiving a threshold voltage CTH produced by a threshold voltage generator (TG) 46 and an output electrically connected to the processor 50. In some embodiments, the processor 16 further includes a signal conditioning circuit 45 having an input receiving the charge detection signal CHD and an output electrically connected to the comparator 44 as shown by example in FIG. 3. In embodiments which do not include the signal conditioning circuit 45, the comparator 44 is operable in a conventional manner to produce a trigger signal TR at the output thereof which is dependent upon the magnitude of the charge detection signal CDH relative to the magnitude of the threshold voltage CTH. In one embodiment, for example, the comparator 44 is operable to produce an "inactive" trigger signal TR at or near a reference voltage, e.g., ground potential, as long as CHD is less than CTH, and is operable to produce an "active" TR signal at or near a supply voltage of the circuitry 40, 42, 44, 45, 46, 50 when CHD is at or exceeds CTH. In alternate embodiments, the comparator 44 may be operable to produce an "inactive" trigger signal TR at or near the supply voltage as long as CHD is less than CTH, and is operable to produce an "active" trigger signal TR at or near the reference potential when CHD is at or exceeds CTH. Those skilled in the art will recognize other differing trigger signal magnitudes and/or differing trigger signal polarities that may be used to establish the "inactive" and "active" states of the trigger signal TR so long as such differing trigger signal magnitudes and/or different trigger signal polarities are distinguishable by the processor 50, and it will be understood that any such other different trigger signal magnitudes and/or differing trigger signal polarities are intended to fall within the scope of this disclosure. In any case, the comparator 44 may additionally be designed in a conventional manner to include a desired amount of hysteresis to prevent rapid switching of the output between the reference and supply voltages.

In some embodiments which include the signal conditioning circuit 45 briefly described above, such a signal conditioning circuit 45 may illustratively be provided in the form of a conventional band-pass filter circuit configured to pass signals within a suitable frequency range so as to pass legitimate charge detection event signals to the comparator 44 but to block higher frequency noise pulses from reaching the comparator 44, thereby reducing the likelihood of noise-triggered detection events. In other embodiments which include the signal conditioning circuit 45, such a signal conditioning circuit 45 may be provided in the form of a signal shaping amplifier configured to produce an edge-detected Gaussian-shaped output signal, i.e., an output signal shaped like a Gaussian function. Such a signal shaping amplifier will illustratively convert the rising edge of a charge detection signal CHD to a short Gaussian-shaped pulse and the falling edge of the charge detection signal CHD to a similar Gaussian-shaped pulse of opposite polarity. In this embodiment, the comparator 44 will produce an "active" trigger signal TR when either of the Gaussian-shaped signals exceeds a switching threshold voltage of the comparator 44.

In the illustrated embodiment, the processor 50 is operable, i.e., programmed, to control the threshold voltage generator 46 to produce the threshold voltage CTH. In one embodiment, the threshold voltage generator 46 is implemented in the form of a conventional controllable DC voltage source configured to be responsive to a digital threshold control signal THC, e.g., in the form of a single serial digital signal or multiple parallel digital signals, to produce an analog threshold voltage CTH having a polarity and a magnitude defined by the digital threshold control signal THC. In alternate embodiments, the threshold voltage generator 46 may be provided in the form of a conventional digital-to-analog (D/A) converter responsive to a serial or parallel digital threshold voltage TCH to produce an analog threshold voltage CTH having a magnitude, and in some embodiments a polarity, defined by the digital threshold control signals THC. In some such embodiments, the D/A converter may form part of the processor 50. Those skilled in the art will recognize other conventional circuits and techniques for selectively producing the threshold voltage CTH of desired magnitude and/or polarity, and it will be understood that any such other conventional circuits and/or techniques are intended to fall within the scope of this disclosure.

In addition to the foregoing functions performed by the processor 50, the processor 50 is further operable to receive and process the output signals MCP produced by the ion detector 24, in embodiments which include the ion detector 24, and to control the voltage sources V1, V2 as described above with respect to FIGS. 2A, 2B to selectively establish ion transmission and reflection fields within the regions R1, R2 of the ion mirrors M1, M2 respectively. In one embodiment, the processor 50 is illustratively provided in the form of a field programmable gate array (FPGA) programmed as just described to collect and store charge detection signals CDS for charge detection events and for ion measurement events, to produce the threshold control signal(s) TCH from which the magnitude and/or polarity of the threshold voltage CTH is determined or derived, and to control the voltage sources V1, V2 based on the ion detection signals MCP and based on the charge detection signals CHD relative to the threshold voltage CTH as determined by monitoring the output signal TR produced by the comparator 44. In this embodiment, the memory 18 described with respect to FIG. 1 is integrated into, and forms part of, the programming of the FPGA. In alternate embodiments, the processor 50 may be provided in the form of one or more conventional microprocessors or controllers and one or more accompanying memory units having instructions stored therein which, when executed by the one or more microprocessors or controllers, cause the one or more microprocessors or controllers to operate as just described. In other alternate embodiments, the processing circuit 50 may be implemented purely in the form of one or more conventional hardware circuits designed to operate as described above, or as a combination of one or more such hardware circuits and at least one microprocessor or controller operable to execute instructions stored in memory to operate as described above.

In any case, the embodiment of the processor 16 depicted in FIG. 3 further illustratively includes a second processor 52 coupled to the first processor 50 and also to the one or more peripheral devices 20. In some embodiments, the processor 52 may include the one or more peripheral devices 20. In any case, the processor 52 is illustratively operable to process the ion measurement event information stored in and/or by the first processor 50 to determine ion charge, mass-to-charge and mass information. The processor 52 may be provided in the form of any conventional computer or computing device capable of processing the ion measurement event information, i.e., having sufficient computing power, to determine, display, store and conduct at least some amount of analysis of ion mass information. In one embodiment, the processor 52 may be provided in the form of a conventional personal computer (PC), although in other embodiments the processor 52 may be or include one or more computers or computing devices with greater or lesser computing power.

As briefly described above with respect to FIGS. 2A and 2B, the voltage sources V1, V2 are illustratively controlled by the processor 50 in a manner which selectively establishes ion transmission and ion reflection electric fields in the region R1 of the ion mirror M1 and in the region R2 of the ion mirror M2 to guide ions introduced into the ELIT 14 from the ion source 12 through the ELIT 14, and to then cause a single ion to be selectively trapped within the ELIT 14 such that the trapped ion repeatedly passes through the charge detector CD as it oscillates back and forth between M1 and M2. Referring to FIGS. 4A-4C, simplified diagrams of the ELIT 14 of FIG. 1 are shown depicting an example of such sequential control and operation of the ion mirrors M1, M2 of the ELIT 14. In the following example, the processor 50 will be described as controlling the operation of the voltage sources V1, V2 in accordance with its programming, although it will be understood that in alternate embodiments the operation of the voltage source V1 and/or the operation of the voltage source V1 may be controlled, at least in part, by the processor 52 in accordance with its programming.

As illustrated in FIG. 4A, the ELIT control sequence begins with the processor 50 controlling the voltage source V1 to control the ion mirror M1 to the ion transmission mode of operation (T) by establishing an ion transmission field within the region R1 of the ion mirror M1, and also controlling the voltage source V2 to control the ion mirror M2 to the ion transmission mode of operation (T) by likewise establishing an ion transmission field within the region R2 of the ion mirror M2. As a result, ions generated by the ion source 12 pass into the ion mirror M1 and are focused by the ion transmission electric field TEF established in the region R1 toward the longitudinal axis 22 as they pass into the charge detection cylinder CD. The ions then pass through the charge detection cylinder CD and into the ion mirror M2 where the ion transmission field established within the region R2 of M2 focusses the ions toward the longitudinal axis 22 such that the ions pass through the exit aperture A1 of M2 as illustrated by the ion trajectory 60 illustrated in FIG. 4A. In the state illustrated in FIG. 4A, M1 and M2 are open and the ELIT 14 is fully open. In some embodiments, ion detection information produced by the ion detector 24 is used to adjust/modify one or more operating parameters or conditions of the ELIT 14 to ensure that one or more ions generated by the ion source 12 successfully enter and pass through the ELIT 14 as just described.

Referring now to FIG. 4B, after both of the ion mirrors M1, M2 have been operating in ion transmission operating mode for a selected time period and/or until successful ion transmission therethrough has been achieved, e.g., by monitoring ion detection signals produced by the ion detector 24 and adjusting/modifying one or more operating parameters or conditions of the ELIT 14 as needed, the processor 50 is illustratively operable to control the voltage source V2 to control the ion mirror M2 to the ion reflection mode (R) of operation by establishing an ion reflection field within the region R2 of the ion mirror M2, while maintaining the ion mirror M1 in the ion transmission mode (T) of operation as shown. As a result, an ion generated by the ion source 12 entering the ion mirror M1 is focused by the ion transmission field established in the region R1 of the ion mirror M1 toward the longitudinal axis 22 such that the ion passes through the ion mirror M1 and into the charge detection cylinder CD as just described with respect to FIG. 4A. The ion then passes through the charge detection cylinder CD and into the ion mirror M2 where the ion reflection field established within the region R2 of M2 reflects, i.e., accelerates, the ion to cause it to travel in the opposite direction and back into the charge detection cylinder CD, as illustrated by the ion trajectory 62 in FIG. 4B. In the state illustrated in FIG. 4B, M1 is open, M2 is closed and the ELIT 14 is thus open at one end (M1) and closed at the other (M2).

Referring now to FIG. 4C, after the ion reflection electric field has been established in the region R2 of the ion mirror M2, the processor 50 is operable to control the voltage source V1 to control the ion mirror M1 to the ion reflection mode (R) of operation by establishing an ion reflection field within the region R1 of the ion mirror M1, while maintaining the ion mirror M2 in the ion reflection mode (R) of operation in order to trap the ion within the ELIT 14. In the state illustrated in FIG. 4C, M1 and M2 are closed, and the ELIT 14 is likewise closed. In some embodiments, the processor 50 is illustratively operable, i.e., programmed, to control the ELIT 14 in a "random trapping mode" in which the processor 50 is operable to control the ion mirror M1 to the reflection mode (R) of operation after the ELIT has been operating in the state illustrated in FIG. 4B, i.e., with M1 in ion transmission mode and M2 in ion reflection mode, for a selected time period. Until the selected time period has elapsed, the ELIT 14 is controlled to operate in the state illustrated in FIG. 4B.

The probability of trapping at least one ion in the ELIT 14 is relatively low using the random trapping mode of operation due to the timed control of M1 to ion reflection mode of operation without any confirmation that at least one ion is trapped within the ELIT 14. The number of trapped ions within the ELIT 14 during the random trapping mode of operation follows a Poisson distribution, and it is generally understood that random or "continuous" trapping is relatively inefficient as less than 0.1% of the ions are trapped.

In other embodiments particularly relevant to this disclosure, the processor 50 is operable, i.e., programmed, to control the ELIT 14 in a "trigger trapping mode" which illustratively carries a substantially greater probability of trapping a single ion therein. In a first version of the trigger trapping mode, the processor 50 is operable to monitor the trigger signal TR produced by the comparator 44 and to control the voltage source V1 to control the ion mirror M1 to the reflection mode (R) of operation to trap an ion within the ELIT 14 if/when the trigger signal TR changes the "inactive" to the "active" state thereof. In some embodiments, the processor 50 may be operable to control the voltage source V1 to control the ion mirror M1 to the reflection mode (R) immediately upon detection of the change of state of the trigger signal TR, and in other embodiments the processor 50 may be operable to control the voltage source V1 to control the ion mirror M1 to the reflection mode (R) upon expiration of a predefined delay period following detection of the change of state of the trigger signal TR. In any case, the change of state of the trigger signal TR from the "inactive" state to the "active" state thereof results from the charge detection signal CHD produced by the charge preamplifier CP reaching or exceeding the threshold voltage CTH, and therefore corresponds to detection of a charge induced on the charge detection cylinder CD by an ion moving therein. With an ion thus moving within the charge detection cylinder CD, control by the processor 50 of the voltage source V1 to control the ion mirror M1 to the reflection mode (R) of operation results in a substantially improved probability, relative to the random trapping mode, of trapping the ion within the ELIT 14. Thus, when an ion has entered the ELIT 14 via the ion mirror M1 and is detected as either passing the first time through the charge detection cylinder CD toward the ion mirror M2 or as passing back through the charge detection cylinder CD after having been reflected by the ion reflection field established within the region R2 of the ion mirror M2 as illustrated in FIG. 4B, the ion mirror M1 is controlled to the reflection mode (R) as illustrated in FIG. 4C to trap the ion within the ELIT 14.

Figure 5A:
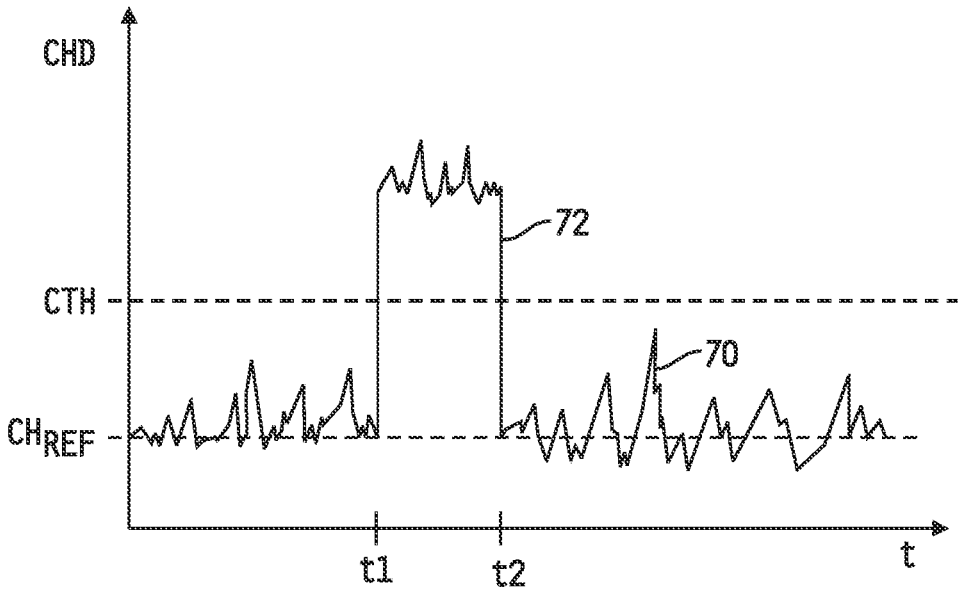
FIG. 5A is a plot of charge detection cylinder charge vs. time illustrating an example charge detection threshold level in comparison to a large amplitude charge detection signal riding on noisy charge reference on the charge detection cylinder.

In a second version of the trigger trapping mode, the process or step illustrated in FIG. 4B is omitted or bypassed, and with the ELIT 14 operating as illustrated in FIG. 4A the processor 50 is operable to monitor the trigger signal TR produced by the comparator 44 and to control both voltage sources V1, V2 to control the respective ion mirrors M1, M2 to the reflection mode (R) of operation to trap an ion within the ELIT 14 if/when the trigger signal TR changes the "inactive" to the "active" state thereof. Thus, when an ion has entered the ELIT 14 via the ion mirror M1 and is detected as passing the first time through the charge detection cylinder CD toward the ion mirror M2 as illustrated in FIG. 4A, the ion mirrors M1 and M2 are both controlled to the reflection mode (R) as illustrated in FIG. 4C to trap the ion within the ELIT 14. In conventional trigger trapping mode with optimized ion inlet signal intensity, e.g., as depicted in FIG. 5A and described below, it has been shown that trapping efficiency, defined here as a ratio of single-ion trapping events and all acquired trapping events, can approach 90% as compared to 37% with random trapping.

In any case, with both of the ion mirrors M1, M2 controlled to the ion reflection operating mode (R) to trap an ion within the ELIT 14, the ion is caused by the opposing ion reflection fields established in the regions R1 and R2 of the ion mirrors M1 and M2 respectively to oscillate back and forth between the ion mirrors M1 and M2, each time passing through the charge detection cylinder CD as illustrated by the ion trajectory 64 depicted in FIG. 4C. In one embodiment, the processor 50 is operable to maintain the operating state illustrated in FIG. 4C until the ion passes through the charge detection cylinder CD a selected number of times. In an alternate embodiment, the processor 50 is operable to maintain the operating state illustrated in FIG. 4C for a selected time period after controlling M1 (and M2 in some embodiments) to the ion reflection mode (R) of operation. When the ion has passed through the charge detection cylinder CD a selected number of times or has oscillated back-and-forth between the ion mirrors M1, M2 for a selected period of time, the sequence illustrated in FIGS. 4A-4C returns to that illustrated in FIG. 4A where the processor 50 is operable, i.e., programmed, to control the voltage sources V1, V2 to control the ion mirrors M1, M2 respectively to the ion transmission mode (T) of operation by establishing an ion transmission fields within the regions R1, R2 of the ion mirrors M1, M2 respectively. The process then repeats for as many times as desired.

With an ion oscillating back and forth between the ion mirrors M1, M2 as illustrated in FIG. 4C, a charge is induced on the charge detector CD of the ELIT 14 each time the ion passes therethrough. Each such induced charge is detected by the charge preamplifier CP, and the corresponding charge detection signal (CHD) produced by the charge preamplifier CP is amplified by the amplifier circuit 40 and digitized by the A/D converter 42, and the magnitude and timing of the digitized charge detection signal CDS is recorded, i.e., stored, by the processor 50 as a charge detection event. Each recorded charge detection event record thus illustratively includes an ion charge value, corresponding to a magnitude of the detected charge, and an oscillation period value, corresponding to the elapsed time between charge detection events. The collection of charge detection events resulting from oscillation of an ion back and forth through the charge detector CD a selected number of times or for a selected time period make up an ion measurement event as this term is defined herein (also referred to as a trapping event).

Ion measurement event data, i.e., charge detection events making up an ion measurement event, is illustratively processed by the processor 52 to determine charge, mass-to-charge ratio and mass values of the ion. In one embodiment, the ion measurement event data is processed by computing, with the processor 16, a Fourier Transform of the recorded collection of charge detection events. The processor 16 is illustratively operable to compute such a Fourier Transform using any conventional digital Fourier Transform (DFT) technique such as for example, but not limited to, a conventional Fast Fourier Transform (FFT) algorithm. In any case, the processor 16 is then illustratively operable to compute an ion mass-to-charge ratio value (m/z), an ion charge value (z) and ion mass values (m), each as a function of the computed Fourier Transform. The processor 16 is illustratively operable to store the computed results in the memory 18 and/or to control one or more of the peripheral devices 20 to display the results for observation and/or further analysis.

It is generally understood that the mass-to-charge ratio (m/z) of an ion oscillating back and forth through the charge detector CD of an ELIT between opposing ion mirrors M1, M2 thereof is inversely proportional to the square of the fundamental frequency ff of the oscillating ion according to the equation:

$$m/z = C/ff^2,$$

where C is a constant that is a function of the ion energy and also a function of the dimensions of the respective ELIT, and the fundamental frequency ff is determined directly from the computed Fourier Transform. The value of the ion charge, z, is proportional to the magnitude FTMAG of the fundamental frequency ff, taking into account the number of ion oscillation cycles. Ion mass, m, is then calculated as a product of m/z and z. In some cases, the magnitude(s) of one or more of the harmonic frequencies of the FFT may be added to the magnitude of the fundamental frequency for purposes of determining the ion charge, z. The processor 16 is thus operable to compute $m/z=C/ff^2$, z=F(FTMAG) and m=(m/z)(z). Multiple, e.g., hundreds or thousands or more, ion trapping events are typically carried out for any particular sample from which the ions are generated by the ion source 12, and ion mass-to-charge, ion charge and ion mass values are determined/computed for each such ion trapping event. The ion mass-to-charge, ion charge and ion mass values for such multiple ion trapping events are, in turn, combined to form spectral information relating to the sample. Such spectral information may illustratively take different forms, examples of which include, but are not limited to, ion count vs. mass-to-charge ratio, ion charge vs. ion mass (e.g., in the form of an ion charge/mass scatter plot), ion count vs. ion mass, ion count vs. ion charge, or the like.

With no charge induced on the charge detector CD by a charged particle passing therethrough, the charge detection cylinder CD illustratively operates at or around a reference charge level $CH_{REF}$. As the charge detection cylinder CD is not powered or grounded, the reference charge level $CH_{REF}$ is typically tens of charges (i.e., elementary charges "e") or less, although in some applications the reference charge level $CH_{REF}$ may be more than tens of charges. The reference charge level $CH_{REF}$ on the charge detection cylinder CD is subject to one or more potentially significant sources of charge noise which may introduce uncertainty in charge detection events as a result of uncertainty in the reference charge level at any point in time. For example, such noise, e.g., in the form of root-mean-square deviation (RMSD) noise, may add at least a factor of 10 or so to the average $CH_{REF}$ level, and even with conventional noise reduction efforts employed it is difficult to reduce the RMSD noise to less than 100 or so charges. Because of this, the threshold voltage CTH for purposes of trigger trapping, as described above with respect to FIGS. 4B and 4C, is typically set sufficiently above the reference charge level $CH_{REF}$ to avoid false triggering of the comparator 44 by charge noise. Referring to FIG. 5A, for example, a plot is shown of the charge detection signal CHD produced by the charge preamplifier CP vs. time in which an example charge noise waveform 70 is shown superimposed on the reference charge level $CH_{REF}$. One source of such charge noise 70 is the input of the charge sensitive preamplifier CP. Capacitance of the charge detector CD also contributes, as does spurious noise caused by external events and extraneous charges induced on the charge detection cylinder resulting from switching of either or both of the ion mirrors M1, M2 between ion transmission and ion reflection modes of operation.

An example trigger trapping event 72 is also illustrated in FIG. 5A which occurs between times $t_1$ and $t_2$. In the illustrated example, at least one ion having a relatively strong charge is detected as passing through the charge detection cylinder such that the charge detection signal CHD produced by the charge preamplifier is substantially greater than the combination of the charge noise 70 and the reference charge level $CH_{REF}$ as shown. In this example, the threshold voltage CTH applied by the threshold voltage generator 46 to the comparator 44 is well-above the combination of the charge noise 70 and the reference charge level $CH_{REF}$ so as not to incur false activations of the trigger signal TR ("false trigger events") by charge noise peaks riding on the reference charge level $CH_{REF}$, and is also well below the magnitude of the charge detection signal CHD during the trigger trapping event 72. In one embodiment, the threshold voltage CTH is illustratively set at a post-preamplifier level that is equivalent to a charge level CH on the charge detection cylinder CD of approximately five times the average combination of the charge noise 70 and the reference charge level $CH_{REF}$ e.g., at least 500 charges or so, although in other embodiments the threshold voltage CTH may be greater or less than this example value.

In the description that follows, the gain of the preamplifier CP illustrated in FIG. 1 and described above will be assumed to be 1.0 to simplify the description of the threshold voltage CTH relative to the charge level CH on the charge detection cylinder CD. If the gain of the preamplifier CP is 1.0, then the charge detection signal CHD=CH and the threshold voltage CTH will thus be compared by the comparator 44 directly with the charge level CH existing on the charge detection cylinder CD at any point in time. It will be understood, however, that a preamplifier gain of 1.0 is assumed only to simplify the following discussion, and that in practice the gain of the preamplifier may be greater than 1.0. Control of the actual threshold voltage CTH implemented in any particular application of the CDMS system 10 will therefore generally take into account the gain of the charge preamplifier CP.

Such charge noise 70, from any source, is undesirable as it necessitates setting a comparator threshold voltage CTH artificially high to avoid false trigger events as just described. However, doing so leaves an undesirably large range of magnitudes of the charge detection signal CHD below CTH which will not cause the comparator 44 to activate the trigger signal TR, but which could have been detectable if not for the high level of charge noise 70. As a result, neither conventional version of trigger trapping described above will can be effectively performed with weakly-charged ions, i.e., ions having charge magnitudes resulting in CHD<CTH.

Figure 5B:
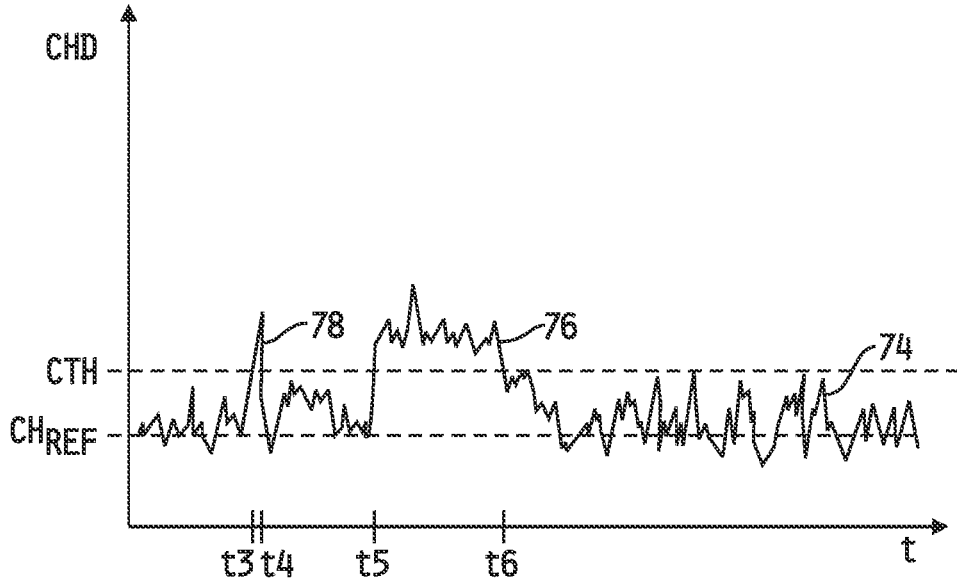
FIG. 5B is a plot of charge detection cylinder charge vs. time illustrating a modified charge detection threshold, as compared with FIG. 3A, selected to provide for triggering on a combination of low-amplitude charge detection signals and noise on the charge detection cylinder during trigger trapping operation of the ELIT.

However, many weakly-charged ions can be detected with specific control of the threshold voltage CTH. For example, as will be shown below, a probabilistic relationship exists between the magnitude of the threshold voltage CTH and corresponding detectable combinations of the charge detection signal CHD resulting from weakly-charged, i.e., low-charge, ions and the charge noise. Thus, as illustrated by example in FIG. 5B, although the charge noise 74 generally remains below the illustrated threshold voltage CTH the combination of the charge noise 74 and a low-charge ion detection event 76 on top of the charge noise 74 between times $t_5$ and $t_6$ rises above CTH, thereby resulting in an active trigger signal TR. The combination of charge noise 74 on the charge detection cylinder CD and a low charge induced on the charge detection cylinder CD by a weakly-charged ion passing therethrough is thus detectable through controlled selection of the threshold voltage CTH. It is possible, however, that peaks in the charge noise 74 alone may exceed CTH and thereby result in an active trigger signal TR which triggers a trapping event by the ELIT 14, as illustrated by the noise peak 78 between times $t_3$ and $t_4$ to in FIG. 5B. Any such noise-based trigger will correspondingly result in an empty trapping event, i.e., one in which no ion is trapped in the ELIT 14. Optimization of the magnitude of the threshold voltage CTH, as will be described below, accordingly requires balancing the conflicting goals of lowering the magnitude of the threshold voltage CTH sufficiently to allow weakly-charged ions to trigger a trapping event while also maintaining the magnitude of the threshold voltage CTH sufficiently high to minimize empty trapping events.

The following analysis illustratively assumes a Gaussian noise spectrum with root-mean-square (RMS) noise charges on the charge detection cylinder CD, and assuming a 50% duty cycle of the ELIT 14, corresponding to a ratio of time spent by an ion in the charge detection cylinder CD of the ELIT 14 and total time spent traversing the first and second ion mirrors M1, M2 and the charge detection cylinder CD during one complete oscillation cycle of a trapping event. It will be understood that the while the numerical values of the results of the following analysis may vary with different duty cycles, the remainder of the analysis will continue to hold true.

Figure 6A:
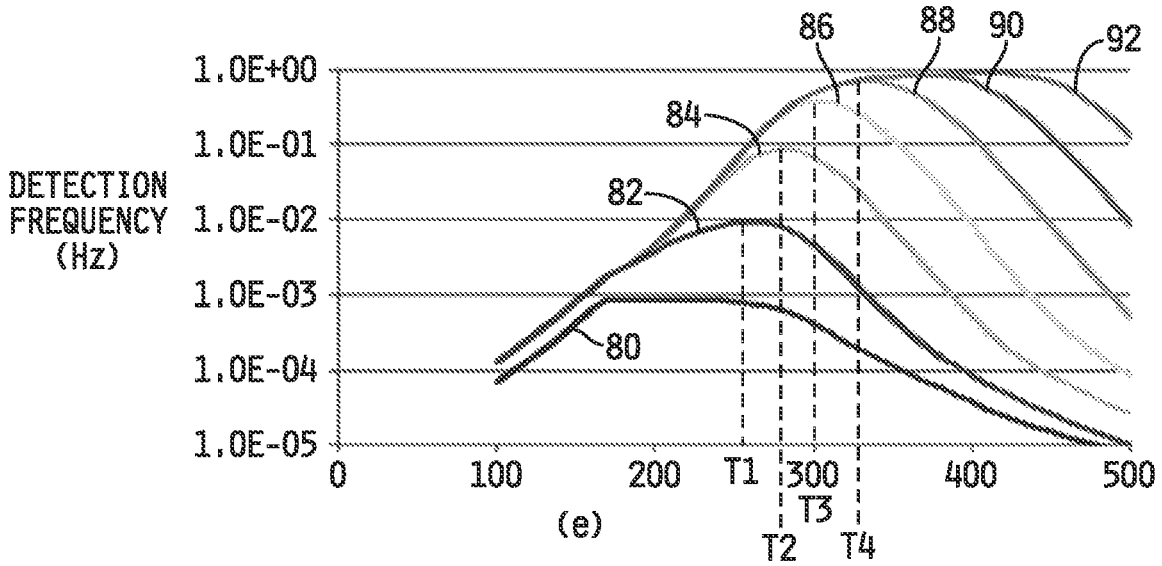
FIG. 6A is a plot of detection frequency vs. comparator threshold for one example ion inlet frequency illustrating example detection frequency and comparator threshold profile pairs associated with various different charge signal amplitudes.

In trigger trapping operation of the ELIT 14 as described above with respect to FIGS. 4A-4C, it can be shown that the detection frequency, defined here as the number of ions per second detectable by the charge detection cylinder CD of the ELIT 14, is a function of both the comparator threshold CTH and the magnitude of the charge of such ions passing through the charge detection cylinder CD ("charge signal amplitude"), i.e., as induced by the charge on the charge detection cylinder CD and detectable by charge preamplifier with a gain of 1.0, which is assigned here for convenience such that the magnitude of the charge detection signal CHD produced by the charge preamplifier CP and compared by the comparator 44 directly with the threshold voltage CTH will be equal to that of the charge, as briefly described above. Referring to FIG. 6A, for example, a plot of detection frequency vs. comparator threshold CTH (in units of charges) is shown illustrating example detection frequency and comparator threshold profile pairs associated with different respective ion charge levels, i.e., charge signal amplitudes.

The profile 80 depicted in FIG. 6A illustratively represents the detection frequency for ions randomly trapped by noise. As illustrated in FIG. 6A, the detection frequency of noise 80 decreases below approximately CTH=170 e because the time interval between noise trigger events below CTH=170 e becomes too small for ions to be able to enter the ELIT 14. Above CTH=170 e, the detection frequency of noise 80 flattens because the trapping time is fixed with a maximum of $t^{-1}$ trapping events per second. Above approximately CTH=270 e, the detection frequency of noise 80 decreases because, in this range, the occurrences of noise exceeding CTH will naturally decrease with increasing CTH magnitude. As FIG. 6A also illustrates, the maximum detection efficiency achieved with noise trigger trapping is slightly less than 0.001, which is the same maximum detection efficiency achievable with random or continuous trigger trapping as described above.

The remaining profiles 82-92 depicted in FIG. 6A illustrate detection frequency profiles for noise plus charge signal trigger trapping with different charge signal amplitudes ranging from 50 to 300 e. For example, the profile 82 corresponds to an ion charge level or charge signal amplitude of 50 e, the profile 84 corresponds to an ion charge level or charge signal amplitude of 100 e, the profile 86 corresponds to an ion charge level or charge signal amplitude of 150 e, the profile 88 corresponds to an ion charge level or charge signal amplitude of 200 e, the profile 90 corresponds to an ion charge level or charge signal amplitude of 250 e and the profile 92 corresponds to an ion charge level or charge signal amplitude of 300 e. In each case, the profiles 82-92 exhibit a single maximum or peak. This maximum or peak illustratively results from the two competing goals describe above. As just described with respect to noise trigger trapping, for example, increasing comparator threshold values CTH above that at which the respective detection frequency peak occurs results in a corresponding decrease in the number of occurrences of the noise+ charge signal amplitude exceeding CTH. On the other hand, as CTH decreases below that at which the respective detection frequency peak occurs, more trapping events are triggered by noise alone and the time available for triggered trapping likewise decreases. The optimum comparator threshold magnitude CTH for each such charge signal amplitude thus occurs at the respective detection frequency peak, thereby maximizing the detection efficiency for ions having the corresponding charge signal amplitude.

As further illustrated in FIG. 6A, the optimum comparator threshold magnitude CTH decreases with decreasing charge signal amplitude. In the illustrated example, the optimum comparator threshold magnitude T1 for a charge signal amplitude of 50 e is approximately 260 e, the optimum comparator threshold magnitude T2 for a charge signal amplitude of 100 e is approximately 280 e, the optimum comparator threshold magnitude T3 for a charge signal amplitude of 150 e is approximately 300 e, the optimum comparator threshold magnitude T4 for a charge signal amplitude of 200 e is approximately 320 e, etc. Although not shown in FIG. 6A, the example detection frequency profiles 80-92 are defined for only one particular ion inlet frequency, in this case 1 Hz. It should be noted that even with a charge amplitude as low as 50 e, selection of the corresponding optimum comparator threshold CTH of approximately 270 e results in a 10-fold increase in detection probability as compared with random or continuous trapping.

For purposes of this description, ion inlet frequency is defined as the number of ions in the flow or beam of ions supplied by the ion source 12 to the ELIT 14 (via the ion inlet aperture A1 of the ion mirror M1 as illustrated by example in FIG. 4A) which pass by a fixed point per second. In any case, different ion inlet frequencies will produce different sets of detection frequency profiles albeit of the same general shape and following the same relationships illustrated in FIG. 6A. Generally, increasing ion inlet frequencies will result in corresponding increases in each of the respective optimum comparator threshold magnitudes. As such, an optimum comparator threshold magnitude value, i.e., at which the respective peak detection frequency occurs, is a function of the charge signal amplitude and a function of the ion inlet frequency.

Figure 6B:
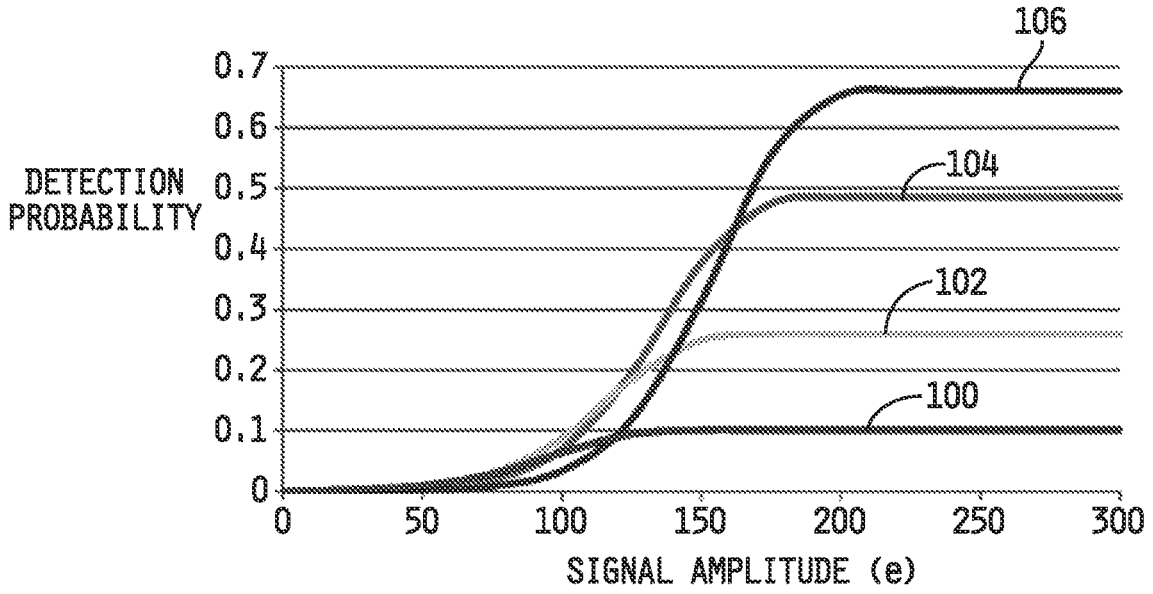
FIG. 6B is a plot of detection probability vs. charge signal amplitude illustrating example detection probability and charge signal amplitude profile pairs associated with different comparator threshold values.

As further still illustrated in FIG. 6A, the maximum achievable detection frequency also decreases with decreasing charge signal amplitude. This feature is also illustrated in FIG. 6B which depicts a plot of detection probability vs. charge signal amplitude for a fixed ion inlet frequency, here again 1 Hz, illustrating example detection probability and charge signal amplitude profiles associated with different comparator threshold values. In the illustrated plot, for example, the profile 100 represents the detection probability vs. charge signal amplitude for a comparator threshold value of 260 e, the profile 102 represents the detection probability vs. charge signal amplitude for a comparator threshold value of 280 e, the profile 104 represents the detection probability vs. charge signal amplitude for a comparator threshold value of 300 e and the profile 106 represents the detection probability vs. charge signal amplitude for a comparator threshold value of 320 e. As with the plot illustrated in FIG. 6A, different ion inlet frequencies will produce different sets of detection probability vs charge signal amplitude profiles of the same general shape and following the same relationships illustrated in FIG. 6B. As such, the detection probability is a function of the charge signal amplitude, of the comparator threshold magnitude and of the ion inlet frequency.

As also illustrated in FIG. 6A and described above, the plot of FIG. 6B demonstrates in a different context that the choice of comparator threshold CTH depends on the charge signal amplitude. Thus, as the charge signal amplitude decreases, the magnitude of the comparator threshold CTH should likewise be controlled to decrease to an optimum value for the charge signal amplitude as illustrated in both FIGS. 6A and 6B. As illustrated most clearly in FIG. 6B, however, doing so will also reduce the detection probability for higher amplitude charge signals since the detection efficiency is reduced by a higher noise triggering rate. FIG. 6B further illustrates that below a certain charge signal amplitude (different for each comparator threshold magnitude) each detection probability decreases, and above the respective certain charge signal amplitudes the magnitudes of the detection probabilities are proportional to the magnitudes of the comparator thresholds. Based on FIG. 6B, it is apparent that when controlling the magnitude of the comparator threshold CTH as illustrated in FIG. 6A to trigger on low-charge signal amplitudes, the intensities of the measured ion spectrum should be corrected using the illustrated decreasing detection probabilities with decreasing comparator threshold magnitudes in order to reflect the relative abundances of the ions supplied by the ion source 12 to the ELIT 14. In this regard, a correction factor arrangement will be described below with respect to FIGS. 6C and 6D.

Figure 6C:
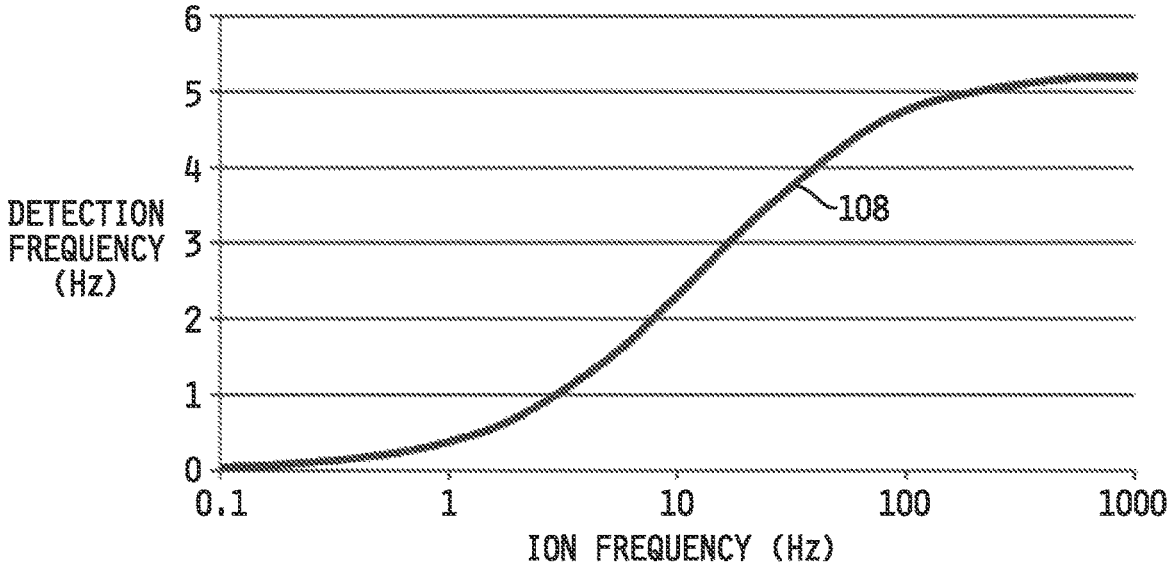
FIG. 6C is a plot of detection frequency vs ion inlet frequency illustrating an example detection frequency and ion inlet frequency profile for a given comparator threshold and charge signal amplitude pair.

Referring now to FIG. 6C, a plot is shown of detection frequency vs. ion inlet frequency illustrating an example detection frequency and ion inlet frequency profile 108 associated with an example pair of charge signal amplitude and optimum comparator threshold magnitude, here, 150 e and 300 e respectively (e.g., corresponding to the intersection of the profile 86 and T3 illustrated in FIG. 6A). It will be understood that different pairs of charge signal amplitude and optimum comparator threshold magnitude will produce different detection frequency vs ion inlet frequency profiles, albeit generally of the same shape. In any case, the profile 108 illustrates that as the ion frequency increases so too does the detection frequency. Illustratively, the profile 108 is non-linear because only a certain number of ions can be detected in the available time.

Figure 6D:
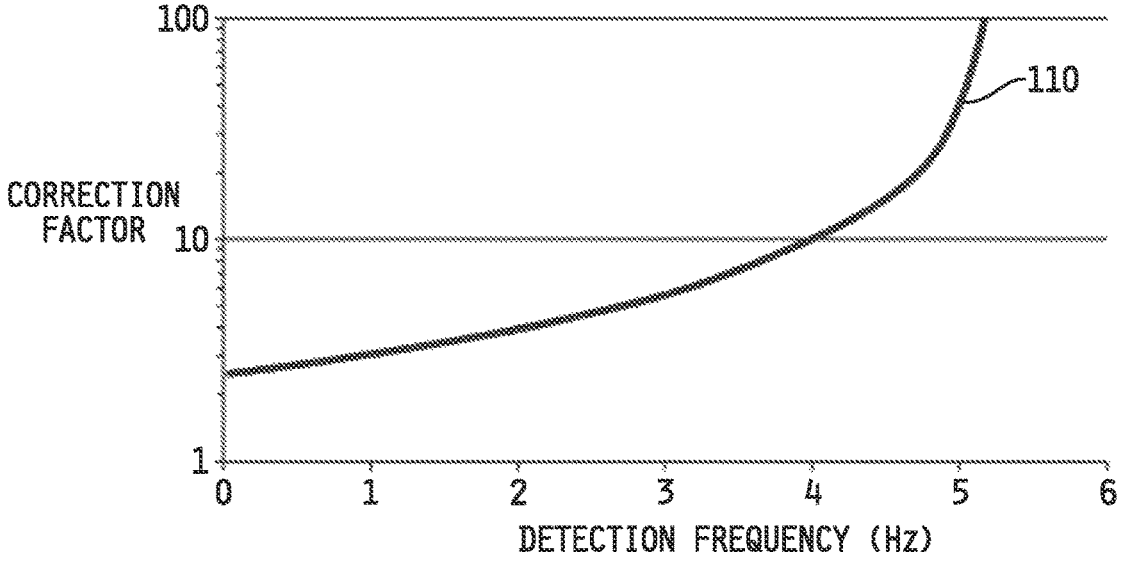
FIG. 6D is a plot of correction factor vs. ion inlet frequency illustrating an example correction factor and ion inlet frequency for a given comparator threshold and ion charge level pair.

Rearrangement of the above-described relationships in the form of detection probability vs. ion inlet frequency illustratively produces a profile similar to that illustrated in FIG. 6C but mirrored about a horizontal axis extending approximately through the midpoint of the profile 108, thereby demonstrating a corresponding non-linear decrease in the detection probability with increasing ion inlet frequency further evidencing the need to account for the attendant decrease in detection efficiency so that the distribution of ion masses in the spectrum reflects the distribution in the flow of ions supplied to the ELIT 14 by the ion source 12. In this regard, FIG. 6D depicts a plot of a correction factor (1/detection probability) vs. detection frequency illustrating an example correction factor and detection frequency profile 110 associated with an example pair of charge signal amplitude and optimum comparator threshold magnitude, again, 150 e and 300 e respectively.

It will be understood that different pairs of charge signal amplitude and optimum comparator threshold magnitude will produce different correction factor vs ion detection frequency profiles, albeit generally of the same shape. In any case, the intensities of the measured ion spectrum will be multiplied by appropriate correction factors so that the intensities in the measured data reflect the relative abundances of the ions in the flow of ions supplied to the ELIT 14 by the ion source 12. Moreover, it is desirable to limit the detection frequency so that the applicable correction factor does not lie on the rapidly rising portion of the profile 110, e.g., greater than about 4.5 Hz). Correction factors in this range are large and strongly dependent upon detection frequency such that small errors in the detection frequency will lead to large errors in the correction factor.

Figure 7:
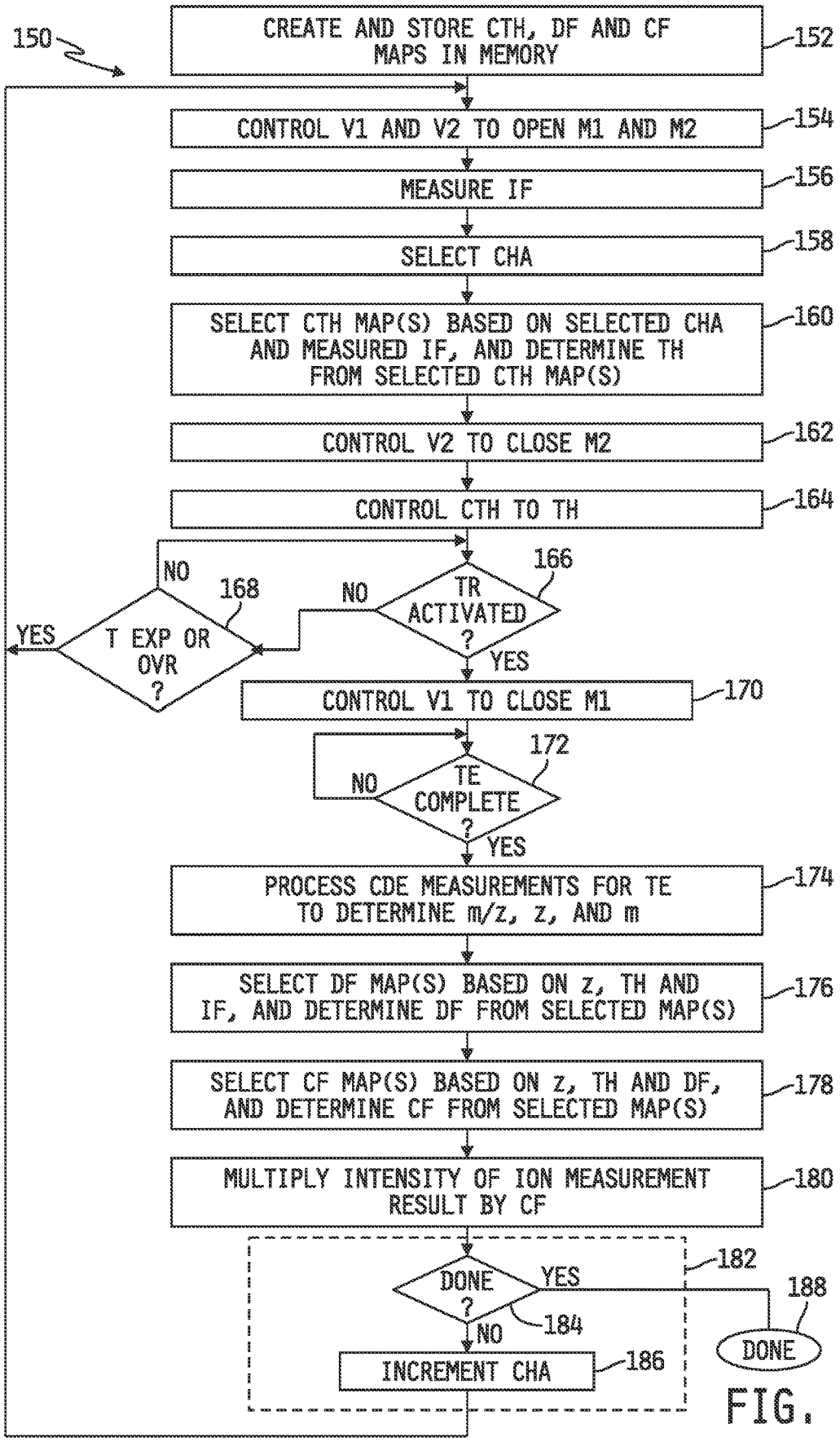
FIG. 7 is a flowchart illustrating an embodiment of a process for selecting and modifying the comparator threshold illustrated in FIG. 3 for trigger trapping control of the ELIT based on detection of low-charge ions.

Referring now to FIG. 7, a flowchart is shown illustrating an embodiment of a process 150 for selecting and modifying the comparator threshold CTH for trigger trapping control of the ELIT 14 triggered by low-charge ions. The process 150 illustratively embodies one example implementation of the concepts illustrated in FIGS. 5B-6D, and is illustratively provided, at least in part, in the form of instructions stored in the memory 18 of the processor 16 which, when executed by the processor 50 and/or 52, cause the processor 50 and/or 52 to execute the operations described below with respect to FIG. 7. In this regard, the process 150 will be described below as being executed by the processor 50, although it will be understood that the process 150 may alternatively be executed, in whole or in part, by the processor 52 or by one or more external processors in communication with the processor 50 and/or the processor 52.

In some embodiments of the process 150, the value(s) of the charge signal amplitude for triggering the ELIT 14 to trap the corresponding ion therein may be manually selected by a user of the CDMS system 10. In some such embodiments, the processor 50 and/or the processor 52 may be programmed to execute a control graphic user interface (GUI) process in which the processor 50 and/or 52 is/are operable to control at least one display monitor included in the peripheral devices 20 to display a corresponding control GUI including one or more selectable GUI elements for entering one or more charge signal amplitude values. In alternate embodiments, the processor 16/50 may be programmed to select the value(s) of the charge signal amplitude, e.g., singly and/or by executing a step-wise sweep of a range of charge signal amplitudes and executing the process 150 at each incremental charge signal amplitude value. Other conventional apparatuses, devices and/or techniques for selecting one or more charge signal amplitude values will occur to those skilled in the art, and it will be understood that any such other conventional apparatuses, devices and/or techniques are intended to fall within the scope of this disclosure.

The process 150 begins at step 152 where, prior to controlling the ELIT in a trigger trapping mode as just, described, the processor 50 is operable to store a number of maps in the memory 18 corresponding to relationships illustrated in some of the FIGS. 6A-6D. In some embodiments, the processor 50 is operable to create one or more such maps and to store the one or more created maps in the memory 18. Alternatively or additionally, one or all of the maps may be created using a different processor and/or system, and transferred to the memory 18 of the processor 50 and/or the processor 52 in a conventional manner. In any case, the processor 50 is illustratively operable at step 152 to create and/or store a set of comparator threshold maps ("CTH maps") in the memory 18 each including multiple pairs of optimum comparator threshold values and corresponding charge signal amplitudes for a different ion inlet frequency to capture at least some of the relationships described above with respect to FIG. 6A. Using FIG. 6A as a non-limiting example, if the charge signal amplitudes for the profiles 82, 84, 86 and 88 are CHA1, CHA2, CHA3 and CHA4 respectively, one example set of CTH maps may include the pairs T1/CHA1, T2/CHA2, T3/CHA3 and T4/CHA4 for each of three different ion inlet frequencies F1=1 Hz, F2=2 Hz and F3=3 Hz. It will be understood that more or fewer such CTH maps may alternatively be created and/or stored for more or fewer ion inlet frequency values, and/or that any such number of CTH maps may include more or fewer optimum comparator threshold value and charge signal amplitude pairs. In any case, the set of CTH maps may illustratively be stored in the memory 18 in any convenient form, examples of which may include, but are not limited to, one or more arrays, one or more lists (linked or otherwise), one or more tables (lookup tables or otherwise), one or more spreadsheets, one or more charts, one or more plots, one or more graphs, one or more relational databases or data structures, or the like.

The processor 50 is further illustratively operable at step 152 to create and/or store a set of detection frequency maps ("DF maps") in the memory 18 each including multiple detection frequency values mapped to corresponding ion inlet frequency values for a different pair of optimized comparator threshold and charge signal amplitude values to capture multiple optimized comparator threshold/charge signal amplitude value instances of the relationship described above with respect to FIG. 6C. Using FIG. 6C as a non-limiting example, one example set of DF maps may include a plurality of pairs of ion frequency values and corresponding detection frequency values for each of the four pairs T1/CHA1, T2/CHA2, T3/CHA3 and T4/CHA4 of optimized comparator threshold/charge signal amplitude values. It will be understood that more or fewer such DF maps may alternatively be created and/or stored for more or fewer pairs of optimized comparator threshold/charge signal amplitude values, and/or that any such number of DF maps may include more or fewer pairs of ion frequency values and corresponding detection frequency values. In any case, the set of DF maps may illustratively be stored in the memory 18 in any convenient form as just described with respect to the set of CTH maps.

The processor 50 is further illustratively operable at step 152 to create and/or store a set of correction factor maps ("CF maps") in the memory 18 each including multiple detection frequency values mapped to corresponding correction factor values for a different pair of optimized comparator threshold and charge signal amplitude values to capture multiple optimized comparator threshold/charge signal amplitude value instances of the relationship described above with respect to FIG. 6D. Using FIG. 6D as a non-limiting example, one example set of CF maps may include a plurality of pairs of correction factor values and corresponding detection frequency values for each of the four pairs T1/CHA1, T2/CHA2, T3/CHA3 and T4/CHA4 of optimized comparator threshold/charge signal amplitude values. It will be understood that more or fewer such CF maps may alternatively be created and/or stored for more or fewer pairs of optimized comparator threshold/charge signal amplitude values, and/or that any such number of CF maps may include more or fewer pairs of correction factor values and corresponding detection frequency values. In any case, the set of CF maps may illustratively be stored in the memory 18 in any convenient form as just described with respect to the set of CTH maps.

Those skilled in the art will appreciate that in some applications the information in the set of DF maps may be combined with the set of CF maps to form a single set of maps including multiple ion inlet frequency values mapped to corresponding correction factor values for a different pair of optimized comparator threshold and charge signal amplitude values to capture in one set of maps multiple optimized comparator threshold/charge signal amplitude value instances of the relationships described above with respect to FIGS. 6B-6D. It will also be understood that in alternate embodiments, the one or more of the variables CTH, DF and CF may be computed based directly on other measured and/or selected parameters. In such embodiments, one or more corresponding sets of maps for CTH, DF and CF need not be created at step 152. In the extreme case where CTH, DF and CF are all computed based directly on other measured and/or selected parameters, step 152 may be omitted.

Following step 152, the process 150 advances to step 154 where the processor 50 is operable to control V1 and V2 to open M1 and M2 (and thus open the ELIT 14) so that ions generated by the ion source 12 pass into and through the ELIT 14 as illustrated by example in FIG. 4A. Thereafter at step 156, the processor 50 is operable to measure the ion inlet frequency IF. As the ion beam or trajectory or flow is, at the time of execution of step 156, passing from the ion source 12 directly through the charge detection cylinder CD, the processor 50 is illustratively operable in one embodiment to measure the ion inlet frequency IF by processing the charge detection signal CDS (see, e.g., FIG. 3) to determine timing information relating to times between occurrences of charges CH induced on the charge detector CD by ions passing therethrough. In other embodiments, the ion inlet frequency may be alternatively or additionally measured by one or more conventional sensors suitably positioned within the ion source 12 and/or between the ion source 12 and the ELIT 14. In still other embodiments, the ion inlet frequency may be alternatively or additionally measured or otherwise determined by an ion separation instrument, e.g., a mass analyzer or mass spectrometer, positioned in the ion source 12 between an ion generating apparatus or device and the ion inlet of the ELIT 14.

Following step 156 (or during step 154 and/or step 156), the process 150 advances to step 158 where a charge signal amplitude value CHA is selected, e.g., by a user of the CDMS 10 and/or automatically by the processor 50 as described above. In any case, CHA selected at step 158 is a charge magnitude value which is desired to be used as a trigger to cause the processor 50 to close the ELIT 14 to trap a corresponding ion therein. Illustratively, CHA has a magnitude less than or equal to the conventional threshold level normally used for strongly charged ions as illustrated in FIG. 5A and described above. Typically, CHA will have a value of between just above the noise floor on the charge detection cylinder CD and noise+500 e or so, although other values of CHA outside this example range may be selected in other embodiments.

Following step 158, the process 150 advances to step 160 where the processor 50 is illustratively operable to select one or more of the CTH maps stored in the memory based on the measured ion inlet frequency IF and on the selected charge signal amplitude value CHA. In some instances, the measured IF value may correspond to a single CTH map, and in other embodiments the measured IF vale may be between IF values of two different CTH maps. In the former case, the processor 50 is operable to retrieve the single CTH map stored in the memory 18 and in the latter case the processor 50 is operable to retrieve the two different CTH maps stored in the memory 18. Once retrieved, the processor 50 is operable to map the selected CHA value to a corresponding optimized comparator threshold value TH using the map(s). In instances in which a single map is retrieved, the processor 50 is operable to select as TH the optimized comparator threshold value paired with the selected CHA value stored in the single selected map. In other instances in which a single map is retrieved, the selected CHA value may be between two CHA values stored in the single map. In such instances, the processor 50 is illustratively operable to estimate a suitable optimized comparator threshold value TH using one or more conventional interpolation techniques or other estimation techniques. Likewise in instances in which two CTH maps are retrieved from memory, conventional interpolation or other estimation techniques may be used to estimate a suitable optimized comparator threshold value TH from the data contained in the two selected tables. In embodiments of the process 150 which do not have a set of CTH maps stored in the memory 18, the processor 50 is alternatively operable at step 160 to compute CTH based on CHA and IF using one or more equations based on the relationships between CTH, CHA and IF illustrated in FIGS. 6A and 6B and described hereinabove.

Following step 160, the processor 50 is illustratively operable at step 162 to control the voltage source V2 to close the ion mirror M2 so that ions generated by the ion source 12 pass into and through the open ion mirror M1 of the ELIT 14 and are reflected by the ion reflection field established in M2 to trap ions entering M2 from the charge detection cylinder CD and then accelerating the trapped ions in the opposite direction back into and through the charge detection cylinder CD as illustrated by example in FIG. 4B. Thereafter at step 164, the processor 50 is operable to control the voltage source 46 (see FIG. 3) to produce the optimized comparator threshold value TH determined from the one or more stored CTH maps at step 160. Thereafter at step 166, the processor 50 is illustratively operable to monitor the trigger signal TR produced by the comparator 44 to determine if/when the trigger signal TR changes from "inactive" to "active," thereby informing the processor 50 that the magnitude of the charge detection signal CHD produced by the charge preamplifier CP has exceeded the magnitude of the optimized comparator threshold TH produced by the voltage source 46 as a result of execution of step 164.

While the trigger signal TR remains "inactive," the process 150 illustratively advances to step 168 where the processor 150 is illustratively operable to determine whether a time T has expired since execution of step 164 or if the user (or processor 50) has overridden the expiry period. If so, the process 150 loops back to step 154 to re-execute the process 150 for selection of another charge signal amplitude value CHA, and otherwise the process 150 loops back to step 166 to continue to monitor TR. Step 168 is illustratively included in some embodiments in which it may be desirable to allow only a predefined time period for the charge detection signal CHD to trigger the comparator 44 and/or to allow the user or processor 150 to cancel and restart the process 150. In any case, if/when the processor 150 determines at step 166 that the trigger signal TR has changed state from "inactive" to "active," the process 150 illustratively advances from the YES branch of step 166 to step 170 where the processor 150 is illustratively operable to control V1 to close M1, thereby closing the ELIT 14 and trapping the ion therein as illustrated in FIG. 4C and described above.

Execution of steps 162-170 illustratively represent control of the ELIT 14 by the processor 50 according to the first version of trigger trapping described above with respect to FIGS. 4A-4C. In alternate embodiments of the process 150, the processor 50 may be operable to control the ELIT 14 according to the second version of trigger trapping as also described above with respect to FIGS. 4A-4C. In such embodiments, step 162 may be omitted and step 170 may be modified to include control of V1 and V2 to close M1 and M2 together or one after the other to close the ELIT 14 to trap the ion therein. In any case, following step 170 the process 150 illustratively advances to step 172 where the processor 50 is operable to determine whether the trapping event begun at step 170 is complete, e.g., by the passage of a predefined or selectable time period or by oscillation of the ion back and forth between the ion mirrors M1, M2 a predefined or selectable number of times. Until the trapping event has concluded, the process 150 loops from the NO branch of step 172 to the beginning of step 172.

When the processor 50 determines at step 172 that the trapping event has concluded, the process 150 advances to step 174 where the processor 50 is illustratively operable to process the charge detection event (CDE) measurement values collected during the trapping event to determine, in a conventional manner, a mass-to-charge value (m/z), a charge (z) and a mass (m) of the ion trapped in the ELIT 14 during the trapping event.

Following step 174, the process 150 advances to step 176 where the processor 50 is illustratively operable to select one or more of the detection frequency (DF) maps stored in the memory based on the measured ion charge z determined at step 174, the optimized comparator threshold value TH determined at step 160 and used at step 164 to conduct the comparison, and the ion inlet frequency IF measured at step 156. In some instances, the measured ion charge z, the optimized comparator threshold value TH and the measured IF value may together identify a single DF map, and in other embodiments the measured ion charge z and/or the optimized comparator threshold value TH and/or the measured IF value may identify two or more different DF maps. As described above with respect to step 160, the processor 50 is operable at step 176 to map the measured IF and z values to a corresponding detection frequency DF using the one or more DF map(s), e.g., directly and/or using one or more conventional interpolation techniques or other estimation techniques. In embodiments of the process 150 which do not have a set of DF maps stored in the memory 18, the processor 50 is alternatively operable at step 176 to compute DF based on the optimized threshold value CTH and the measured values of IF and z using one or more equations based on the relationships between CTH, ion charge amplitude and IF illustrated in FIG. 6C and described hereinabove.

Following step 176, the process 150 advances to step 178 where the processor 50 is illustratively operable to select one or more of the correction factor (CF) maps stored in the memory based on the measured ion charge z determined at step 174, the optimized comparator threshold value TH determined at step 160 and used at step 164 to conduct the comparison and the detection frequency DF just determined at step 174. In some instances, the charge signal amplitude value CHA, the optimized comparator threshold value TH and the DF value determined at step 176 may together identify a single CF map, and in other embodiments the measured ion charge z and/or the optimized comparator threshold value TH and/or the determined DF value may identify two or more different CF maps. As described above with respect to step 160, the processor 50 is operable at step 178 to map the determined DF value to a corresponding correction factor CF using the one or more CF map(s), e.g., directly and/or using one or more conventional interpolation techniques or other estimation techniques. In alternate embodiments in which the DF and CF maps are combined into a single set of maps as described above, steps 176 and 178 may likewise be replaced with a single step in which the CF value is determined from such single set of maps. In other alternate embodiments, steps 176 and 178, or the single step just described, may be executed during execution of any one or more of steps 162-174.

In embodiments of the process 150 which do not have a set of CF maps stored in the memory 18, the processor 50 is alternatively operable to compute CF based on the optimized threshold value CTH selected at step 160 and used at step 164 to conduct the comparison, the measured ion charge z determined at step 174 and the DF value determined at step 176 using one or more equations based on the relationships between CTH, ion charge amplitude and DF illustrated in FIG. 6D and described hereinabove. In other alternate embodiments, steps 176 and 178 may be combined such that the processor 50 is operable to compute CF based on the optimized threshold value CTH selected at step 160 and used at step 164 to conduct the comparison and the measured values of ion charge z determined at step 174 and IF determined at step 156 using one or more equations based on the relationships between CTH, ion charge amplitude and IF illustrated in FIGS. 6C and 6D and described hereinabove.

Following step 178, the process 150 advances to step 180 where the processor 50 is illustratively operable to multiply the intensity of the ion measurements determined at step 174 by the correction factor CF so that the ion intensities in the measured spectrum are corrected to reflect the relative abundances of the ions supplied by the ion source 12 to the ELIT 14. As one example, the correction factor CF determined for each ion measurement illustratively operates as a weighting factor multiplier against a default count value of 1.0 for each detected ion such that, when the correction factor CF is included, the default count (1.0) of the measured ion is multiplied by the correction factor CF. If the detection probability of the ion is 0.5, for example, the correction factor is therefore 2.0 and the weighted count value of the measured ion is therefore likewise 2.0. Thus, because the detection efficiency of this example ion is only 0.5, the measured count value will only be half of that in the ion supplied by the ion source 12 to the ELIT 14, and the measured count value of this ion must therefore be corrected by the correction factor so as to be correctly counted as 2 ions in order to reflect the corresponding abundance of this ion in the ions being supplied by the ion source 12 to the ELIT 14.

In embodiments of the process 150 in which a user manually or otherwise selects the charge signal amplitude value CHA at step 158, the process 150 illustratively advances from step 180 to step 188 where the process 150 concludes. In alternate embodiments in which the processor 150 is operable to sweep CHA over a selected range of CHA values, the process 180 illustratively includes an additional step 182 following step 180 as shown by dashed-line representation in FIG. 7. In such embodiments, step 182 illustratively includes a step 184 in which the processor 150 is operable to determine whether the process 150 has been executed with each of the CHA values in the selected range. If so, the process concludes at step 188. Otherwise, the process 150 follows the NO branch of step 184 to step 186 where the processor 50 is operable to increment the charge signal amplitude value CHA by a programmed or selected incremental step value, after which the process 150 loops back to step 154 to re-execute the process 150 using the new CHA value. It will be understood that in such embodiments, step 158 will be skipped as the new CHA value has already been selected at step 186.

Figure 8A:
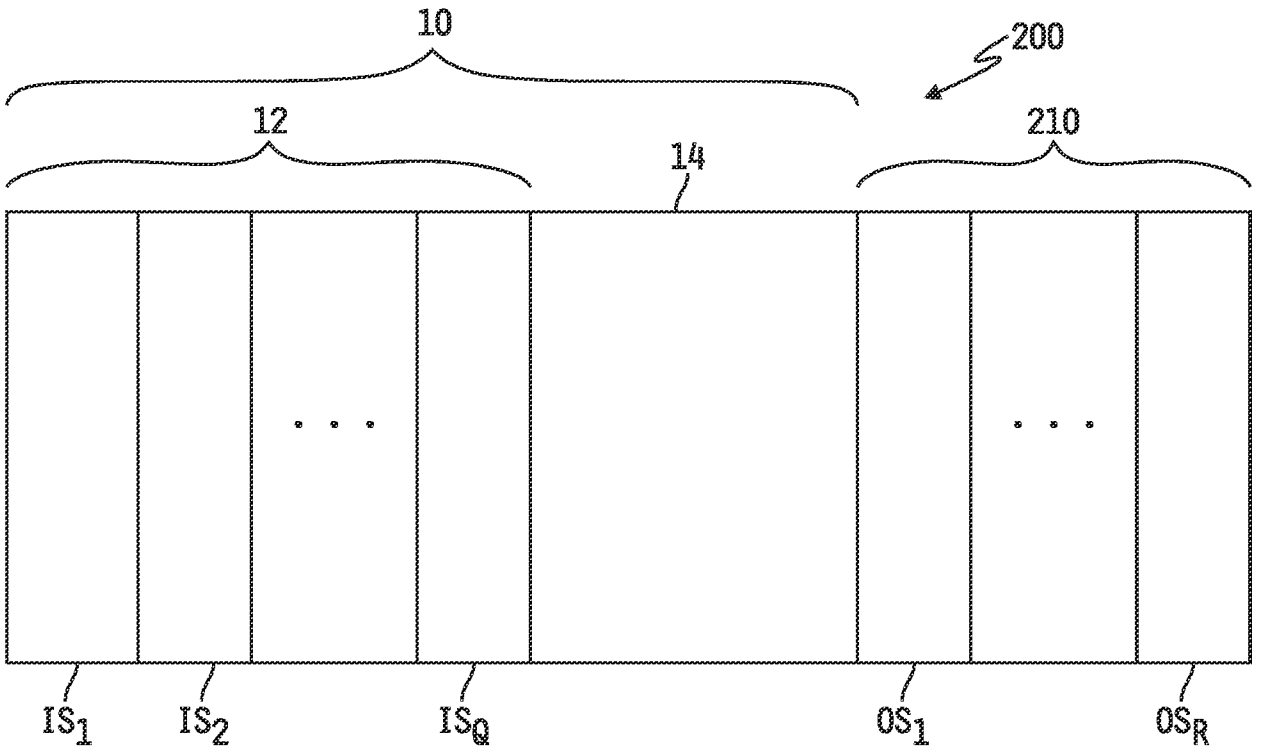
FIG. 8A is a simplified block diagram of an embodiment of an ion separation instrument including the ELIT illustrated in FIGS. 1-3 and operating as described herein, showing example ion processing instruments which may form part of the ion source upstream of the ELIT and/or which may be disposed downstream of the ELIT to further process ion(s) exiting the ELIT.

Referring now to FIG. 8A, a simplified block diagram is shown of an embodiment of an ion separation instrument 200 which may include the ELIT 14 configured and operable as described herein, which may include the charge detection mass spectrometer (CDMS) 10 configured and operable as described herein, and which may include any number of ion processing instruments forming part of the ion source 12 upstream of the ELIT 14 and/or which may include any number of ion processing instruments disposed downstream of the ELIT 14 to further process ion(s) exiting the ELIT 14. In this regard, the ion source 12 is illustrated in FIG. 8A as including a number, Q, of ion source stages $IS_1IS_Q$ which may be or form part of the ion source 12, where Q may be any positive integer. Alternatively or additionally, an ion processing instrument 210 is illustrated in FIG. 8A as being coupled to the ion outlet of the ELIT 14, wherein the ion processing instrument 210 may include any number of ion processing stages $OS_1$-$OS_R$, where R may be any positive integer.

Focusing on the ion source 12, it will be understood that the source 12 of ions entering the ELIT 14 may be or include, in the form of one or more of the ion source stages $IS_1$-$IS_Q$, one or more conventional sources of ions as described above, and may further include one or more conventional instruments for separating ions according to one or more molecular characteristics (e.g., according to ion mass, ion mass-to-charge, ion mobility, ion retention time, or the like) and/or one or more conventional ion processing instruments for collecting and/or storing ions (e.g., one or more quadrupole, hexapole and/or other ion traps), for filtering ions (e.g., according to one or more molecular characteristics such as ion mass, ion mass-to-charge, ion mobility, ion retention time and the like), for fragmenting or otherwise dissociating ions, for normalizing or shifting ion charge states, and the like. It will be understood that the ion source 12 may include one or any combination, in any order, of any such conventional ion sources, ion separation instruments and/or ion processing instruments, and that some embodiments may include multiple adjacent or spaced-apart ones of any such conventional ion sources, ion separation instruments and/or ion processing instruments.

Turning now to the ion processing instrument 210, it will be understood that the instrument 210 may be or include, in the form of one or more of the ion processing stages $OS_1$-$OS_R$, one or more conventional instruments for separating ions according to one or more molecular characteristics (e.g., according to ion mass, ion mass-to-charge, ion mobility, ion retention time, or the like) and/or one or more conventional ion processing instruments for collecting and/or storing ions (e.g., one or more quadrupole, hexapole and/or other ion traps or guides), for filtering ions (e.g., according to one or more molecular characteristics such as ion mass, ion mass-to-charge, ion mobility, ion retention time and the like), for fragmenting or otherwise dissociating ions, for normalizing or shifting ion charge states, and the like. It will be understood that the ion processing instrument 210 may include one or any combination, in any order, of any such conventional ion separation instruments and/or ion processing instruments, and that some embodiments may include multiple adjacent or spaced-apart ones of any such conventional ion separation instruments and/or ion processing instruments. In any implementation which includes one or more mass spectrometers, any one or more such mass spectrometers may be implemented in any of the forms described above with respect to FIG. 1.

As one specific implementation of the ion separation instrument 200 illustrated in FIG. 8A, which should not be considered to be limiting in any way, the ion source 12 illustratively includes 3 stages, and the ion processing instrument 210 is omitted. In this example implementation, the ion source stage $IS_1$ is a conventional source of ions, e.g., electrospray, MALDI or the like, the ion source stage $IS_2$ is a conventional ion filter, e.g., a quadrupole or hexapole ion guide, and the ion source stage $IS_3$ is a mass spectrometer of any of the types described above. In this embodiment, the ion source stage $IS_2$ is controlled in a conventional manner to preselect ions having desired molecular characteristics for analysis by the downstream mass spectrometer, and to pass only such preselected ions to the mass spectrometer, wherein the ions analyzed by the ELIT 14 will be the preselected ions separated by the mass spectrometer according to mass-to-charge ratio. The preselected ions exiting the ion filter may, for example, be ions having a specified ion mass or mass-to-charge ratio, ions having ion masses or ion mass-to-charge ratios above and/or below a specified ion mass or ion mass-to-charge ratio, ions having ion masses or ion mass-to-charge ratios within a specified range of ion mass or ion mass-to-charge ratio, or the like. In some alternate implementations of this example, the ion source stage $IS_2$ may be the mass spectrometer and the ion source stage $IS_3$ may be the ion filter, and the ion filter may be otherwise operable as just described to preselect ions exiting the mass spectrometer which have desired molecular characteristics for analysis by the downstream ELIT 14. In other alternate implementations of this example, the ion source stage $IS_2$ may be the ion filter, and the ion source stage $IS_3$ may include a mass spectrometer followed by another ion filter, wherein the ion filters each operate as just described.

As another specific implementation of the ion separation instrument 200 illustrated in FIG. 8A, which should not be considered to be limiting in any way, the ion source 12 illustratively includes 2 stages, and the ion processing instrument 210 is again omitted. In this example implementation, the ion source stage $IS_1$ is a conventional source of ions, e.g., electrospray, MALDI or the like, the ion source stage $IS_2$ is a conventional mass spectrometer of any of the types described above. This is the implementation of the CDMS 10 described above with respect to FIG. 1 in which the ELIT 14 is operable to analyze ions exiting the mass spectrometer.

As yet another specific implementation of the ion separation instrument 200 illustrated in FIG. 8A, which should not be considered to be limiting in any way, the ion source 12 illustratively includes 2 stages, and the ion processing instrument 210 is omitted. In this example implementation, the ion source stage $IS_1$ is a conventional source of ions, e.g., electrospray, MALDI or the like, and the ion processing stage $OS_2$ is a conventional single or multiple-state ion mobility spectrometer. In this implementation, the ion mobility spectrometer is operable to separate ions, generated by the ion source stage $IS_1$, over time according to one or more functions of ion mobility, and the ELIT 14 is operable to analyze ions exiting the ion mobility spectrometer. In an alternate implementation of this example, the ion source 12 may include only a single stage $IS_1$ in the form of a conventional source of ions, and the ion processing instrument 210 may include a conventional single or multiple-stage ion mobility spectrometer as a sole stage $OS_1$ (or as stage $OS_1$ of a multiple-stage instrument 210). In this alternate implementation, the ELIT 14 is operable to analyze ions generated by the ion source stage $IS_1$, and the ion mobility spectrometer $OS_1$ is operable to separate ions exiting the ELIT 14 over time according to one or more functions of ion mobility. As another alternate implementation of this example, single or multiple-stage ion mobility spectrometers may follow both the ion source stage $IS_1$ and the ELIT 14. In this alternate implementation, the ion mobility spectrometer following the ion source stage $IS_1$ is operable to separate ions, generated by the ion source stage $IS_1$, over time according to one or more functions of ion mobility, the ELIT 14 is operable to analyze ions exiting the ion source stage ion mobility spectrometer, and the ion mobility spectrometer of the ion processing stage $OS_1$ following the ELIT 14 is operable to separate ions exiting the ELIT 14 over time according to one or more functions of ion mobility.

As still another specific implementation of the ion separation instrument 200 illustrated in FIG. 8A, which should not be considered to be limiting in any way, the ion source 12 illustratively includes 2 stages, and the ion processing instrument 210 is omitted. In this example implementation, the ion source stage $IS_1$ is a conventional liquid chromatograph, e.g., HPLC or the like configured to separate molecules in solution according to molecule retention time, and the ion source stage $IS_2$ is a conventional source of ions, e.g., electrospray or the like. In this implementation, the liquid chromatograph is operable to separate molecular components in solution, the ion source stage $IS_2$ is operable to generate ions from the solution flow exiting the liquid chromatograph, and the ELIT 14 is operable to analyze ions generated by the ion source stage $IS_2$. In an alternate implementation of this example, the ion source stage $IS_1$ may instead be a conventional size-exclusion chromatograph (SEC) operable to separate molecules in solution by size. In another alternate implementation, the ion source stage $IS_1$ may include a conventional liquid chromatograph followed by a conventional SEC or vice versa. In this implementation, ions are generated by the ion source stage $IS_2$ from a twice separated solution; once according to molecule retention time followed by a second according to molecule size, or vice versa.

Figure 8B:
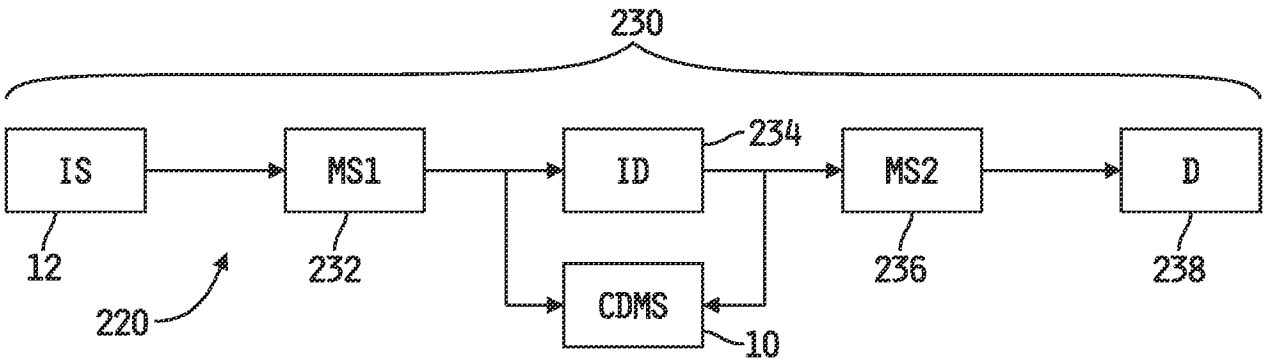
FIG. 8B is a simplified block diagram of another embodiment of an ion separation instrument including the ELIT illustrated in FIGS. 1-3 and operating as described herein, showing an example implementation which combines conventional ion processing instruments with any of the embodiments of the ion mass detection system illustrated and described herein.

Referring now to FIG. 8B, a simplified block diagram is shown of another embodiment of an ion separation instrument 220 which illustratively includes a multi-stage mass spectrometer instrument 230 and which also includes the ion mass detection system 10, i.e., CDMS, illustrated and described herein implemented as a high-mass ion analysis component. In the illustrated embodiment, the multi-stage mass spectrometer instrument 230 includes an ion source (IS) 12, as illustrated and described herein, followed by and coupled to a first conventional mass spectrometer (MS1) 232, followed by and coupled to a conventional ion dissociation stage (ID) 234 operable to dissociate ions exiting the mass spectrometer 232, e.g., by one or more of collision-induced dissociation (CID), surface-induced dissociation (SID), electron capture dissociation (ECD) and/or photo-induced dissociation (PID) or the like, followed by and coupled to a second conventional mass spectrometer (MS2) 236, followed by a conventional ion detector (D) 238, e.g., such as a microchannel plate detector or other conventional ion detector. The ion mass detection system 10, i.e., CDMS, is coupled in parallel with and to the ion dissociation stage 234 such that the ion mass detection system 10, i.e., CDMS, may selectively receive ions from the mass spectrometer 236 and/or from the ion dissociation stage 232.

MS/MS, e.g., using only the ion separation instrument 230, is a well-established approach where precursor ions of a particular molecular weight are selected by the first mass spectrometer 232 (MS1) based on their m/z value. The mass selected precursor ions are fragmented, e.g., by collision-induced dissociation, surface-induced dissociation, electron capture dissociation, or photo-induced dissociation, in the ion dissociation stage 234. The fragment ions are then analyzed by the second mass spectrometer 236 (MS2). Only the m/z values of the precursor and fragment ions are measured in both MS1 and MS2. For high mass ions, the charge states are not resolved and so it is not possible to select precursor ions with a specific molecular weight based on the m/z value alone. However, by coupling the instrument 230 to the CDMS 10 illustrated and described herein, it is possible to select a narrow range of m/z values and then use the CDMS 10 to determine the masses of the m/z selected precursor ions. The mass spectrometers 232, 236 may be, for example, one or any combination of a magnetic sector mass spectrometer, time-of-flight mass spectrometer or quadrupole mass spectrometer, although in alternate embodiments other mass spectrometer types may be used. In any case, the m/z selected precursor ions with known masses exiting MS1 can be fragmented in the ion dissociation stage 234, and the resulting fragment ions can then be analyzed by MS2 (where only the m/z ratio is measured) and/or by the CDMS instrument 10 (where the m/z ratio and charge are measured simultaneously). Low mass fragments, i.e., dissociated ions of precursor ions having mass values below a threshold mass value, e.g., 10,000 Da (or other mass value), can thus be analyzed by conventional MS, using MS2, while high mass fragments (where the charge states are not resolved), i.e., dissociated ions of precursor ions having mass values at or above the threshold mass value, can be analyzed by CDMS 10.

It will be understood that the dimensions of the various components of the ELIT 14 and the magnitudes of the electric fields established therein, as implemented in any of the systems 10, 200, 220 illustrated in the attached figures and described above, may illustratively be selected so as to establish a desired duty cycle of ion oscillation within the ELIT 14, corresponding to a ratio of time spent by an ion in the charge detection cylinder CD and a total time spent by the ion traversing the combination of the ion mirrors M1, M2 and the charge detection cylinder CD during one complete oscillation cycle. For example, a duty cycle of approximately 50% may be desirable for the purpose of reducing noise in fundamental frequency magnitude determinations resulting from harmonic frequency components of the measured signals. Details relating to such dimensional and operational considerations for achieving a desired duty cycle, e.g., such as 50%, are illustrated and described in U.S. Patent Application Ser. No. 62/616,860, filed Jan. 12, 2018, U.S. Patent Application Ser. No. 62/680,343, filed Jun. 4, 2018 and International Patent Application No. PCT/US2019/013251, filed Jan. 11, 2019, all entitled ELECTROSTATIC LINEAR ION TRAP DESIGN FOR CHARGE DETECTION MASS SPECTROMETRY, the disclosures of which are all expressly incorporated herein by reference in their entireties.

It will be further understood that one or more charge calibration or resetting apparatuses may be used with the ELIT 14 alone and/or in any of the systems 10, 200, 220 illustrated in the attached figures and described herein. An example of one such charge calibration or resetting apparatus is illustrated and described in U.S. Patent Application Ser. No. 62/680,272, filed Jun. 4, 2018 and in International Patent Application No. PCT/US2019/013284, filed Jan. 11, 2019, both entitled APPARATUS AND METHOD FOR CALIBRATING OR RESETTING A CHARGE DETECTOR, the disclosures of which are both expressly incorporated herein by reference in their entireties.

It will be still further understood that the trigger trapping techniques illustrated in the attached figures and described herein may be implemented in each of two or more ELITs and/or in each of two or more ELIT regions in systems and/or applications which include at least one ELIT array having two or more ELITs or having two or more ELIT regions. Examples of some such ELITs and/or ELIT arrays are illustrated and described in U.S. Patent Application Ser. No. 62/680,315, filed Jun. 4, 2018 and in International Patent Application No. PCT/US2019/013283, filed Jan. 11, 2019, both entitled ION TRAP ARRAY FOR HIGH THROUGHPUT CHARGE DETECTION MASS SPECTROMETRY, the disclosures of which are both expressly incorporated herein by reference in their entireties.

It will be further understood that one or more ion source optimization apparatuses and/or techniques may be used with one or more embodiments of the ion source 12 as part of or in combination with any of the systems 10, 200, 220 illustrated in the attached figures and described herein, some examples of which are illustrated and described in U.S. Patent Application Ser. No. 62/680,223, filed Jun. 4, 2018 and entitled HYBRID ION FUNNEL-ION CARPET (FUNPET) ATMOSPHERIC PRESSURE INTERFACE FOR CHARGE DETECTION MASS SPECTROMETRY, and in International Patent Application No. PCT/US2019/013274, filed Jan. 11, 2019 and entitled INTERFACE FOR TRANSPORTING IONS FROM AN ATMOSPHERIC PRESSURE ENVIRONMENT TO A LOW PRESSURE ENVIRONMENT, the disclosures of which are both expressly incorporated herein by reference in their entireties.

It will be still further understood that the trigger trapping techniques illustrated in the attached figures and described herein may be implemented in or as part of systems configured to operate in accordance with real-time analysis and/or real-time control techniques, some examples of which are illustrated and described in U.S. Patent Application Ser. No. 62/680,245, filed Jun. 4, 2018 and International Patent Application No. PCT/US2019/013277, filed Jan. 11, 2019, both entitled CHARGE DETECTION MASS SPECTROMETRY WITH REAL TIME ANALYSIS AND SIGNAL OPTIMIZATION, the disclosures of which are both expressly incorporated herein by reference in their entireties. As one non-limiting example, one or more real-time control apparatus and/or techniques described in the patent application identified in this paragraph may be used to select one or more values of the charge signal amplitude values CHA, to control the voltage source 44 illustrated in FIG. 3 to selectively control the magnitude of the comparator threshold voltage CTH, and/or to modify or regulate the signal intensity of ions entering the ELIT and/or the detection frequency as described above with respect to FIG. 6D.

It will be still further understood that in any of the systems 10, 200, 220 illustrated in the attached figures and described herein, the ELIT 14 may be replaced with an orbitrap, and that the trigger trapping techniques illustrated in the attached figures and described herein may be used with such an orbitrap. An example of one such orbitrap is illustrated and described in U.S. Patent Application Ser. No. 62/769,952, filed Nov. 20, 2018 and in International Patent Application No. PCT/US2019/013278, filed Jan. 11, 2019, both entitled ORBITRAP FOR SINGLE PARTICLE MASS SPECTROMETRY, the disclosures of which are both expressly incorporated herein by reference in their entireties.

It will be yet further understood that the trigger trapping techniques illustrated and described herein may be used in systems and/or applications in which one or more ion inlet trajectory control apparatuses and/or techniques is/are used to provide for simultaneous measurements of multiple individual ions within the ELIT 14. Examples of some such ion inlet trajectory control apparatuses and/or techniques are illustrated and described in U.S. Patent Application Ser. No. 62/774,703, filed Dec. 3, 2018 and in International Patent Application No. PCT/US2019/013285, filed Jan. 11, 2019, both entitled APPARATUS AND METHOD FOR SIMULTANEOUSLY ANALYZING MULTIPLE IONS WITH AN ELECTROSTATIC LINEAR ION TRAP, the disclosures of which are both expressly incorporated herein by reference in their entireties.

While this disclosure has been illustrated and described in detail in the foregoing drawings and description, the same is to be considered as illustrative and not restrictive in character, it being understood that only illustrative embodiments thereof have been shown and described and that all changes and modifications that come within the spirit of this disclosure are desired to be protected. For example, it will be understood that the ELIT 14 illustrated in the attached figures and described herein is provided only by way of example, and that the concepts, structures and techniques described above may be implemented directly in ELITs of various alternate designs. Any such alternate ELIT design may, for example, include any one or combination of two or more ELIT regions, more, fewer and/or differently-shaped ion mirror electrodes, more or fewer voltage sources, more or fewer DC or time-varying signals produced by one or more of the voltage sources, one or more ion mirrors defining additional electric field regions, or the like.

What is claimed is:

1. A system for trapping ions for measurement thereof, comprising:

an electrostatic linear ion trap (ELIT), a source of ions configured to supply ions to the ELIT, a processor operatively coupled to the ELIT, and a memory having instructions stored therein which, when executed by the processor, cause the processor to (i) produce at least one control signal to open the ELIT to allow ions supplied by the source of ions to enter the ELIT, (ii) determine an ion inlet frequency corresponding to a frequency of ions flowing from the source of ions into the open ELIT, (iii) generate or receive a target ion charge value, (iv) determine an optimum threshold value as a function of the target ion charge value and the determined ion inlet frequency, and (v) produce at least one control signal to close the ELIT when a charge of an ion within the ELIT exceeds the optimum threshold value to thereby trap the ion in the ELIT.

2. The system of claim 1, wherein the ELIT includes a first ion mirror defining a first passageway, a second ion mirror defining a second ion passageway and a charge detection cylinder defining a third passageway therethrough, wherein the first, second and third passageways are coaxially aligned with the charge detection cylinder disposed between the first and second ion mirrors such that a longitudinal axis of the ELIT passes centrally through each of the first, second and third passageways, the first ion mirror defining an ion inlet aperture via which ions supplied by the source of ions flow into the ELIT, and further comprising at least one voltage source operatively coupled to the processor and to the first and second ion mirrors and configured to produce voltages for selectively establishing an ion transmission electric field or an ion reflection electric field therein, the ion transmission electric field configured to focus an ion passing through a respective one of the first and second ion mirrors toward the longitudinal axis, the ion reflection electric field configured to cause an ion entering a respective one of the first and second ion mirrors from the charge detection cylinder to stop and accelerate in an opposite direction back through the charge detection cylinder and toward the other of the first and second ion mirrors while also focusing the ion toward the longitudinal axis.

3. The system of claim 2, wherein the instructions stored in the memory further include instructions which, when executed by the processor, cause the processor to produce at least one control signal to open the ELIT by controlling the at least one voltage source to establish the ion transmission electric field in the first and second ion mirrors such that ions supplied by the source of ions flow into the first ion mirror and then through the charge detection cylinder and the second ion mirror, each ion flowing through the charge detection cylinder inducing a respective charge thereon.

4. The system of claim 2, wherein the instructions stored in the memory further include instructions which, when executed by the processor, cause the processor to produce at least one control signal to close the ELIT by controlling the at least one voltage source to simultaneously establish the ion reflection electric field in the first and second ion mirrors when the charge of the ion within the ELIT exceeds the optimum threshold value to thereby trap the ion in the ELIT and cause the trapped ion to oscillate back and forth between the first and second ion mirrors each time passing through the charge detection cylinder and inducing a corresponding charge thereon.

5. The system of claim 2, wherein the instructions stored in the memory further include instructions which, when executed by the processor, cause the processor to produce at least one control signal to close the ELIT by controlling the at least one voltage source to establish the ion reflection electric field in the second ion mirror after determining the optimum threshold value, and, after the ion reflection electric field is established in the second ion mirror, controlling the at least one voltage source to establish the ion reflection electric field in the first ion mirror when the charge of the ion within the ELIT exceeds the optimum threshold value to thereby trap the ion in the ELIT, wherein the ion reflection electric fields established in the first and second ion mirrors together cause the trapped ion to oscillate back and forth between the first and second ion mirrors each time passing through the charge detection cylinder and inducing a corresponding charge thereon.

6. The system of claim 2, further comprising a charge preamplifier having an input operatively coupled to the charge detection cylinder and an output operatively coupled to the processor, the charge preamplifier configured to produce a charge detection signal at the output thereof each time a charge is induced on the charge detection cylinder by an ion passing therethrough, wherein the instructions stored in the memory further include instructions which, when executed by the processor, cause the processor to determine the ion inlet frequency by monitoring the charge detection signals produced by the charge preamplifier as the ions entering the ELIT from the ion source pass through the charge detection cylinder and determining a frequency of the monitored charge detection signals.

7. The system of claim 2, further comprising:

a charge preamplifier having an input operatively coupled to the charge detection cylinder and an output operatively coupled to the processor, the charge preamplifier configured to produce a charge detection signal at the output thereof each time a charge is induced on the charge detection cylinder by an ion passing therethrough, a threshold generator circuit having an input coupled to the processor and an output, and a comparator circuit having a first input coupled to an output of the charge preamplifier, a second input coupled to the output of the threshold generator circuit, and an output coupled to the processor, wherein the instructions stored in the memory further include instructions which, when executed by the processor, cause the processor to control the threshold generator to produce a signal at the output thereof equal to the optimum threshold value, to monitor the output of the comparator and to produce the at least one control signal to close the ELIT in response to a change of state of the output of the comparator resulting from a magnitude of the charge detection signal produced by the charge preamplifier exceeding the optimum threshold value.

8. The system of claim 7, further comprising a band-pass filter coupled between the output of the charge preamplifier and the first input of the comparator, the band-pass filter restricting the charge detection signal produced by the charge preamplifier to a predefined band of frequencies less than a frequency range of noise on the charge detection cylinder.

9. The system of claim 7, further comprising a signal shaping amplifier coupled between the output of the charge preamplifier and the first input of the comparator, the signal shaping amplifier producing a Gaussian-shaped pulse on each of rising and falling edges of the charge detection signal produced by the charge preamplifier.

10. The system of claim 2, further comprising a charge preamplifier having an input operatively coupled to the charge detection cylinder and an output operatively coupled to the processor, the charge preamplifier configured to produce a charge detection signal at the output thereof each time a charge is induced on the charge detection cylinder by an ion passing therethrough, and wherein the instructions stored in the memory further include instructions which, when executed by the processor, cause the processor to record the charge detection signals produced by the charge preamplifier resulting from repeated detection of a charge of the ion over a duration of a trapping event in which the ion is trapped within the ELIT, and wherein the instructions stored in the memory further include instructions which, when executed by the processor, cause the processor to process the recorded charge detection signals to determine a charge of the trapped ion and at least one of a mass-to-charge ratio and a mass of the trapped ion.

11. The system of claim 10, wherein the instructions stored in the memory further include instructions which, when executed by the processor, cause the processor to determine a correction factor as a function of the determined optimum threshold value, the determined ion inlet frequency and the determined charge of the trapped ion, and to correct an intensity of the measured ion by the correction factor to reflect a relative abundance of the ion in the ions supplied by the ion source to the ELIT.

12. The system of claim 11 wherein the instructions stored in the memory further include instructions which, when executed by the processor, cause the processor to determine a detection frequency of the trapped ion as a function of the determined ion inlet frequency and the determined charge of the trapped ion, and to determine the correction factor as a function of the determined detection frequency, the determined optimum threshold value and the determined charge of the trapped ion.

13. The system of claim 12, wherein the memory has stored therein a plurality of detection frequency maps each including multiple detection frequency values mapped to corresponding ion inlet frequency values for a different pair of optimum threshold and ion charge amplitude values, and wherein the instructions stored in the memory further include instructions which, when executed by the processor, cause the processor to determine the detection frequency by selecting one or more of the plurality of detection frequency maps stored in the memory based on the determined charge of the trapped ion, the determined optimum threshold value and the determined ion inlet frequency, and to determine the detection frequency from the selected one or more of the plurality of detection frequency maps based on the determined charge of the trapped ion, the determined optimum threshold value and the determined ion inlet frequency.

14. The system of claim 13, wherein the memory has stored therein a plurality of correction factor maps each including multiple correction factor values mapped to corresponding detection frequency values for a different pair of optimum threshold and ion charge amplitude values, and wherein the instructions stored in the memory further include instructions which, when executed by the processor, cause the processor to determine the correction factor by selecting one or more of the plurality of correction factor maps stored in the memory based on the determined charge of the trapped ion, the determined optimum threshold value and the determined detection frequency, and to determine the correction factor from the selected one or more of the plurality of correction factor maps based on the determined charge of the trapped ion, the determined optimum threshold value and the determined detection frequency.

15. The system of claim 1, further comprising means for determining the ion inlet frequency and providing the determined ion inlet frequency to the processor.

16. The system of claim 1, further comprising a display monitor, wherein the instructions stored in the memory further include instructions which, when executed by the processor, cause the processor to control the display monitor to display a control graphic user interface (GUI) including one or more selectable GUI elements, and to receive the target ion charge value via user interaction with the one or more selectable GUI elements.

17. The system of claim 1, wherein the memory has stored therein a plurality of optimum threshold value maps each including a plurality of optimum threshold values mapped to corresponding charge values for a different ion inlet frequency, and wherein the instructions stored in the memory further include instructions which, when executed by the processor, cause the processor to determine the optimum threshold value by selecting one or more of the plurality of optimum threshold maps stored in the memory based on the target ion charge value and on the determined ion inlet frequency, and to determine the optimum threshold value from the selected one or more of the plurality of optimum threshold maps based on the target ion charge value and the determined ion inlet frequency.

18. A system for separating ions, comprising:

the ion trapping system of claim 1, wherein the source of ions is configured to generate ions from a sample, and at least one ion separation instrument configured to separate the generated ions as a function of at least one molecular characteristic, wherein ions exiting the at least one ion separation instrument are supplied to the ELIT.

19. A system for separating ions, comprising:

an ion source configured to generate ions from a sample, a first mass spectrometer configured to separate the generated ions as a function of mass-to-charge ratio, an ion dissociation stage positioned to receive ions exiting the first mass spectrometer and configured to dissociate ions exiting the first mass spectrometer, a second mass spectrometer configured to separate dissociated ions exiting the ion dissociation stage as a function of mass-to-charge ratio, and the system of claim 18 coupled in parallel with and to the ion dissociation stage such that the system of claim 18 can receive ions exiting either of the first mass spectrometer and the ion dissociation stage, wherein the system of claim 18 is a charge detection mass spectrometer (CDMS), wherein masses of precursor ions exiting the first mass spectrometer are measured using the CDMS, mass-to-charge ratios of dissociated ions of precursor ions having mass values below a threshold mass are measured using the second mass spectrometer, and mass-to-charge ratios and charge values of dissociated ions of precursor ions having mass values at or above the threshold mass are measured using the CDMS.

20. A method of trapping in an electrostatic linear ion trap (ELIT) ions supplied by a source of ions for measurement thereof, the method comprising:

(i) producing, with a processor, at least one control signal to open the ELIT to allow ions supplied by the source of ions to enter the ELIT, (ii) determining, with the processor, an ion inlet frequency corresponding to a frequency of ions flowing from the source of ions into the open ELIT, (iii) generating or receiving, with the processor, a target ion charge value, (iv) determining, with the processor, an optimum threshold value as a function of the target ion charge value and the determined ion inlet frequency, and (v) producing, with the processor, at least one control signal to close the ELIT when a charge of an ion within the ELIT exceeds the optimum threshold value to thereby trap the ion in the ELIT.

* * * * *